US011738907B2

(12) United States Patent
Mueller

(10) Patent No.: US 11,738,907 B2
(45) Date of Patent: Aug. 29, 2023

(54) STACKABLE AND VENTABLE CONTAINERS

(71) Applicant: Genpak, LLC, Charlotte, NC (US)

(72) Inventor: Paul C. Mueller, Charlotte, NC (US)

(73) Assignee: Genpak, LLC, Charlotte, NC (US)

( * ) Notice: Subject to any disclaimer, the term of this patent is extended or adjusted under 35 U.S.C. 154(b) by 513 days.

(21) Appl. No.: 16/445,638

(22) Filed: Jun. 19, 2019

(65) Prior Publication Data

US 2020/0399018 A1 Dec. 24, 2020

(51) Int. Cl.

| | |
|---|---|
| ***B65D 21/02*** | (2006.01) |
| ***B65D 43/16*** | (2006.01) |
| ***B65D 51/16*** | (2006.01) |
| ***B65D 21/04*** | (2006.01) |

(52) U.S. Cl.

CPC ..... *B65D 21/0222* (2013.01); *B65D 21/048* (2013.01); *B65D 43/162* (2013.01); *B65D 51/1672* (2013.01); *B65D 2205/00* (2013.01)

(58) Field of Classification Search

CPC ..... B65D 21/0222; B65D 21/048; B65D 43/162; B65D 51/1672; B65D 2205/00; B65D 21/0233; B65D 2543/00101; B65D 2543/00222; B65D 2543/00296; B65D 2543/00351; B65D 2543/00657; B65D 2543/00694; B65D 2543/00768; B65D 2543/00805; B65D 2543/00842; B65D 51/1677

USPC ..... 220/836

See application file for complete search history.

(56) References Cited

U.S. PATENT DOCUMENTS

| | | | | |
|---|---|---|---|---|
| 2,304,912 A | | 12/1942 | Henchert | |
| 3,955,710 A | | 5/1976 | Commisso | |
| 4,253,600 A | * | 3/1981 | Schubert | B65D 43/162 426/418 |
| 4,375,862 A | * | 3/1983 | Kurinsky | B65D 43/0212 220/293 |
| 4,530,440 A | | 7/1985 | Leong | |
| 4,535,889 A | | 8/1985 | Terauds | |
| 4,687,117 A | | 8/1987 | Terauds | |
| RE32,739 E | | 8/1988 | Terauds | |

(Continued)

FOREIGN PATENT DOCUMENTS

| | | | | |
|---|---|---|---|---|
| EP | 2210819 A1 | * | 7/2010 | B65D 43/0254 |
| WO | WO-2022189904 A1 | * | 9/2022 | |

(Continued)

OTHER PUBLICATIONS

U.S. Appl. No. 29/695,419, Office Action dated Nov. 2, 2020.

(Continued)

*Primary Examiner* — Jennifer Robertson
*Assistant Examiner* — Eric C Baldrighi
(74) *Attorney, Agent, or Firm* — Laurence & Phillips IP Law

(57) ABSTRACT

A container includes a base, a lid, and a hinge that connects the base and lid. The containers may be configured to be vertically stackable in an closed position and still permit venting via vents in the lid of each container. The containers may also be nested in an open position with indentations in the base to facilitate separation of the containers. The indentations may be in one of two positions with an alternating pattern when the containers are in the nested arrangement.

28 Claims, 15 Drawing Sheets

(56) References Cited

U.S. PATENT DOCUMENTS

| | | | | |
|---|---|---|---|---|
| 4,989,748 | A | 2/1991 | Parr | |
| 5,069,344 | A * | 12/1991 | Dehart | B65D 5/68 206/508 |
| 5,114,766 | A | 5/1992 | Jacques | |
| D361,035 | S | 8/1995 | Krupa | |
| 5,897,011 | A | 4/1999 | Brilliant et al. | |
| 6,134,832 | A * | 10/2000 | Bokmiller | A01G 9/021 206/509 |
| 6,257,434 | B1 * | 7/2001 | Lizzio | B65D 77/048 220/4.23 |
| 6,305,546 | B1 | 10/2001 | Saunders et al. | |
| 6,644,494 | B2 * | 11/2003 | Hayes | B65D 21/0219 206/508 |
| 7,287,660 | B2 | 10/2007 | Ramirez | |
| 7,900,793 | B2 * | 3/2011 | Hanson | B65D 21/022 220/526 |
| 8,127,961 | B2 | 3/2012 | Vovan | |
| 8,272,526 | B1 | 9/2012 | Vovan et al. | |
| D668,536 | S | 10/2012 | Sanfilippo | |
| D683,623 | S | 6/2013 | Chen | |
| 8,469,217 | B2 | 6/2013 | Gingras | |
| 8,613,368 | B2 * | 12/2013 | Nordland | B29C 48/07 220/367.1 |
| D697,795 | S | 1/2014 | Garza | |
| D742,222 | S | 11/2015 | Liu | |
| D749,412 | S | 2/2016 | Hu | |
| 9,474,420 | B2 * | 10/2016 | Oakes | B65D 21/064 |
| D793,811 | S | 8/2017 | Ng | |
| D805,857 | S | 12/2017 | Mei | |
| 10,138,020 | B2 * | 11/2018 | Gosen | B65D 21/0233 |
| D907,482 | S | 1/2021 | Ng | |
| 11,511,910 | B1 * | 11/2022 | Bontrager | B65D 1/34 |
| 2005/0000966 | A1 * | 1/2005 | Nordland | B65D 43/162 220/367.1 |
| 2005/0035118 | A1 * | 2/2005 | Garg | B65D 43/162 220/4.23 |
| 2005/0247709 | A1 | 11/2005 | Atkins et al. | |
| 2006/0068063 | A1 * | 3/2006 | Zerfas | B65D 51/2878 426/120 |
| 2007/0045317 | A1 | 3/2007 | Rosender | |
| 2007/0138180 | A1 | 6/2007 | Vovan | |
| 2012/0005994 | A1 | 1/2012 | Tidball et al. | |
| 2012/0006842 | A1 * | 1/2012 | Overgaag | B65D 21/0217 220/810 |
| 2013/0313257 | A1 | 11/2013 | Gartz et al. | |
| 2014/0166659 | A1 | 6/2014 | Antal et al. | |
| 2014/0319137 | A1 | 10/2014 | Hsieh | |
| 2015/0069064 | A1 | 3/2015 | Johnson | |
| 2015/0321799 | A1 | 11/2015 | Lam | |
| 2016/0176573 | A1 * | 6/2016 | Baum | B65D 43/162 206/508 |
| 2017/0144805 | A1 | 5/2017 | Zhou | |
| 2017/0158397 | A1 | 6/2017 | Guirguis et al. | |
| 2019/0352048 | A1 * | 11/2019 | Simms, II | B65D 21/0223 |

FOREIGN PATENT DOCUMENTS

| | | | |
|---|---|---|---|
| WO | WO-2022237203 | A1 * | 11/2022 |
| WO | WO-2022260826 | A1 * | 12/2022 |

OTHER PUBLICATIONS

U.S. Appl. No. 29/695,419, Response dated Feb. 2, 2021.
U.S. Appl. No. 29/695,419, Notice of Allowance dated Mar. 1, 2021.
U.S. Appl. No. 16/445,543, Office Action dated Jul. 8, 2021.
U.S. Appl. No. 16/445,543, Response dated Aug. 12, 2021.
U.S. Appl. No. 16/445,543, Notice of Allowance dated Dec. 10, 2021.

* cited by examiner

STACKABLE AND VENTABLE CONTAINERS

FIELD OF THE INVENTION

The present disclosure generally relates to stackable containers having vents and to containers that are easily separated when nested together.

BRIEF DESCRIPTION OF THE DRAWINGS

The written disclosure herein describes illustrative embodiments that are non-limiting and non-exhaustive. Reference is made to certain of such illustrative embodiments that are depicted in the figures, as listed below.

Figure 1A:
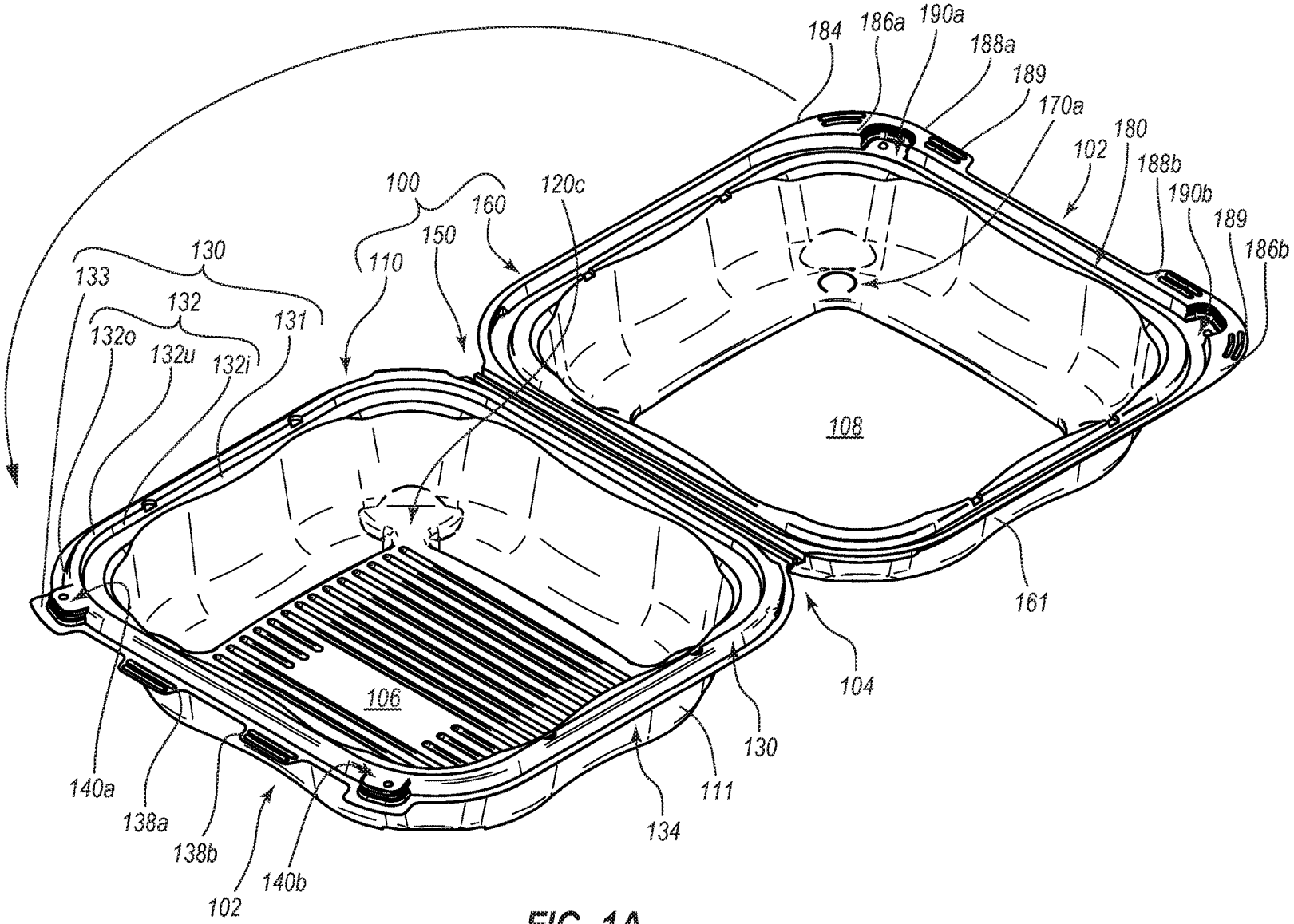
FIG. 1A is a perspective view of an embodiment of a stackable container in an open position with its vent in a closed configuration.

It should be noted that these figures are intended to illustrate the general characteristics of methods, structure and/or materials utilized in certain exemplary embodiments and to supplement the written description provided below. These drawings are not, however, to scale and may not precisely reflect the precise structural or performance characteristics of any given embodiment, and should not be interpreted as defining or limiting the range of values or properties encompassed by exemplary embodiments. For example, the relative thicknesses and positioning of components may be reduced or exaggerated for clarity. The use of similar or identical reference numbers in the various drawings is intended to indicate the presence of a similar or identical element or feature.

DETAILED DESCRIPTION OF EXEMPLARY EMBODIMENTS

The inventive concepts will now be described more fully hereinafter with reference to the accompanying drawings, in which exemplary embodiments of the inventive concepts are shown. The advantages and features of the inventive concepts and methods of achieving them will be apparent from the following exemplary embodiments that will be described in more detail with reference to the accompanying drawings. It should be noted, however, that the inventive concepts are not limited to the following exemplary embodiments, and may be implemented in various forms. Accordingly, the exemplary embodiments are provided only to disclose the inventive concepts and let those skilled in the art know the category of the inventive concepts. In the drawings, embodiments of the inventive concepts are not limited to the specific examples provided herein. The same reference numerals or the same reference designators denote the same elements throughout the specification.

The terminology used herein is for the purpose of describing particular embodiments only and is not intended to limit the invention. As used herein, the singular terms "a," "an" and "the" are intended to include the plural forms as well, unless the context clearly indicates otherwise. As used herein, the term "and/or" includes any and all combinations of one or more of the associated listed items. It will be further understood that the terms "comprises," "comprising," "includes," and/or "including", when used herein, specify the presence of stated features, integers, steps, operations, elements, and/or components, but do not preclude the presence or addition of one or more other features, integers, steps, operations, elements, components, and/or groups thereof.

Moreover, exemplary embodiments are described herein with reference to cross-sectional views, perspective views, and/or top or plan views that are idealized exemplary views. Accordingly, variations from the shapes of the illustrations as a result, for example, of manufacturing techniques and/or tolerances, are to be expected. Thus, exemplary embodiments should not be construed as limited to the shapes of regions illustrated herein but are to include deviations in shapes that result, for example, from manufacturing. For example, an edge may be illustrated with sharp ends and without rounded or curved features even though such rounded or curved features may be preferable. Thus, the regions or elements illustrated in the figures may be schematic in nature and their shapes may not illustrate the actual shape of a region or an element of a container and are not intended to limit the scope of example embodiments.

The embodiments disclosed herein relate to containers that may be used, for example, in the food industry. In particular, embodiments disclosed herein relate to containers that may be stored in a nested arrangement, may be used for containing and/or transporting food products in a stacked arrangement, and may vent heat and/or moisture while in a stacked arrangement.

Food containers are used by consumers for packaging take-out items and/or leftovers. Such containers may contain hot food, which may warm the air within the container. The warm air in turn may cause moisture to condense onto the cooler sides and/or top of the container, which can drip onto the food. While condensation may not affect the quality of all hot food, items such as fried goods can become soggy upon exposure to such moisture. For example, if the hot food includes french fries and a hamburger with a bun, any condensation that forms can dampen the bun, rendering it unappetizing and/or unable to be held to physically support the hamburger for convenient consumption. The venting of the food containers to release the warm air from the interior of the container avoids undesirable condensation from affecting the food product. The vents prevent condensation that forms from hot food contents from adversely affect the quality of the food products contained therein. The container is stackable, including when closed and loaded with hot food, but still allow heat and/or moisture to vent from each of the containers when multiple containers are stacked together.

Restaurants and other users of food packaging, such as grocery stores, delis and take-out delivery services, use containers to package a variety of food products having a variety of temperatures. The containers are used to package food products, and are ideally compact when open and nested, and when closed and stacked. The containers are easily separated when nested in the open position and then loaded with food. Such containers are also easy to load with food and are efficiently designed, such as being readily foldable. Ideally, the containers, are economically and/or environmentally appealing, and able to maintain the quality and temperature of the food product stored inside.

The design of the disclosed containers permits the containers to be efficiently nested together when open, and multiple closed containers may be stacked together while maintaining their venting capacity. When stacked, the containers enable the stack to stay together without tipping. However, the stacked containers are easily separated from each other when desired such that the food loaded in the containers may be consumed.

Figure 1B:
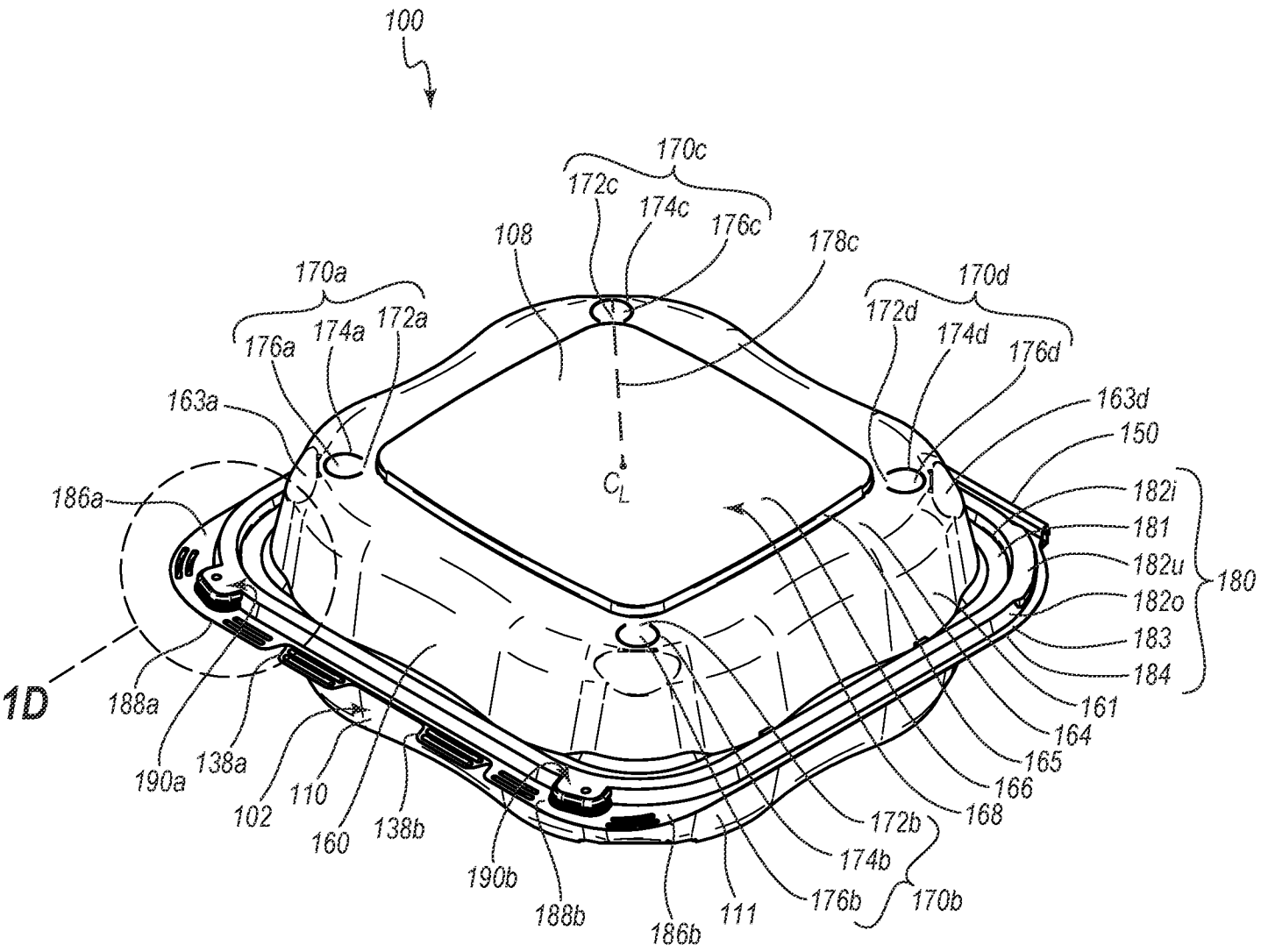
FIG. 1B is a perspective view of the container of FIG. 1A after the lid has been moved to the base as shown in FIG. 1A such that the container is in a closed position.
Figure 2A:
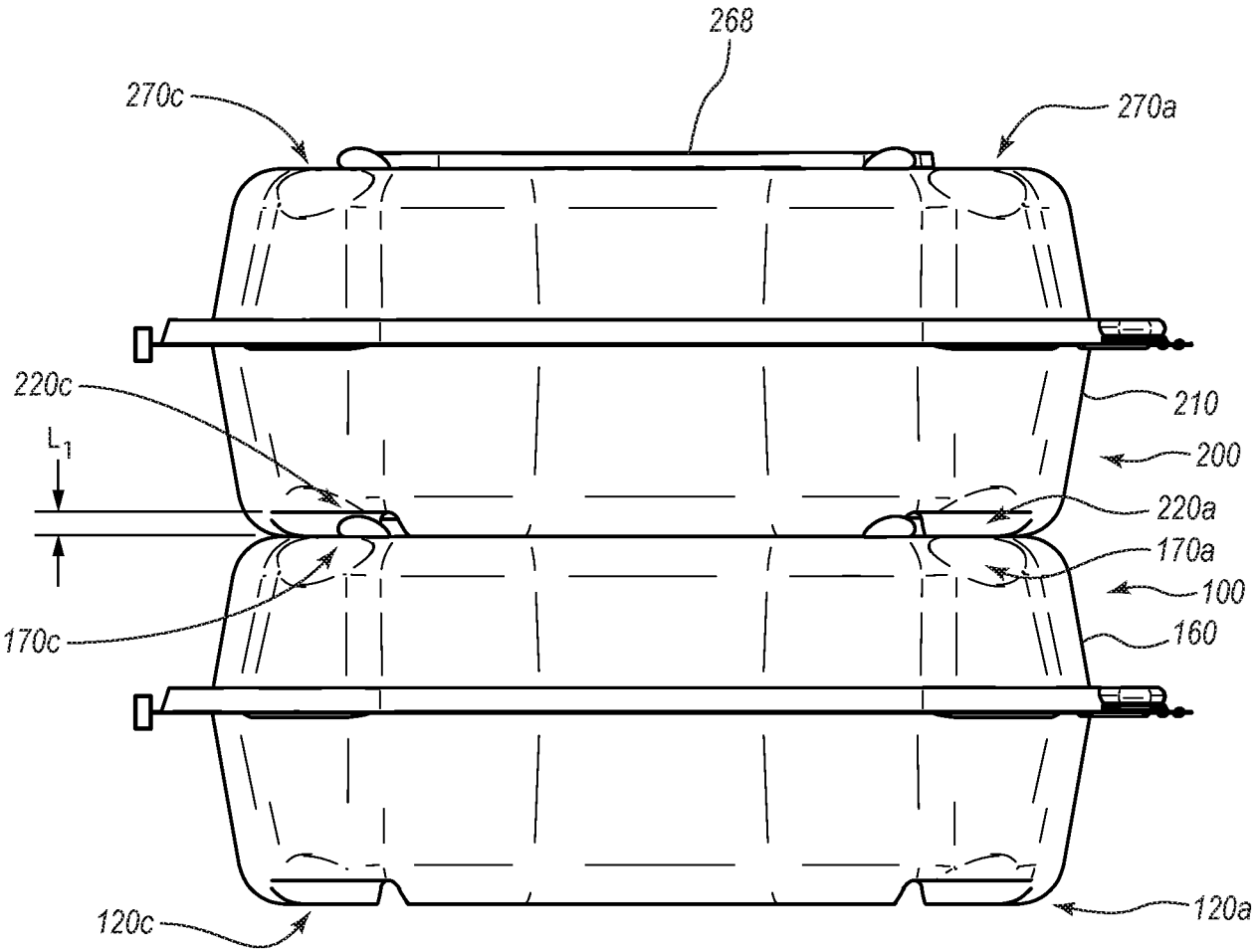
FIG. 2A is a side view of a first container in the closed position stacked on a second container in the closed position that are in a stacked arrangement to show the vertical offset of the stacking structures relative to the adjacent platforms.
Figure 2B:
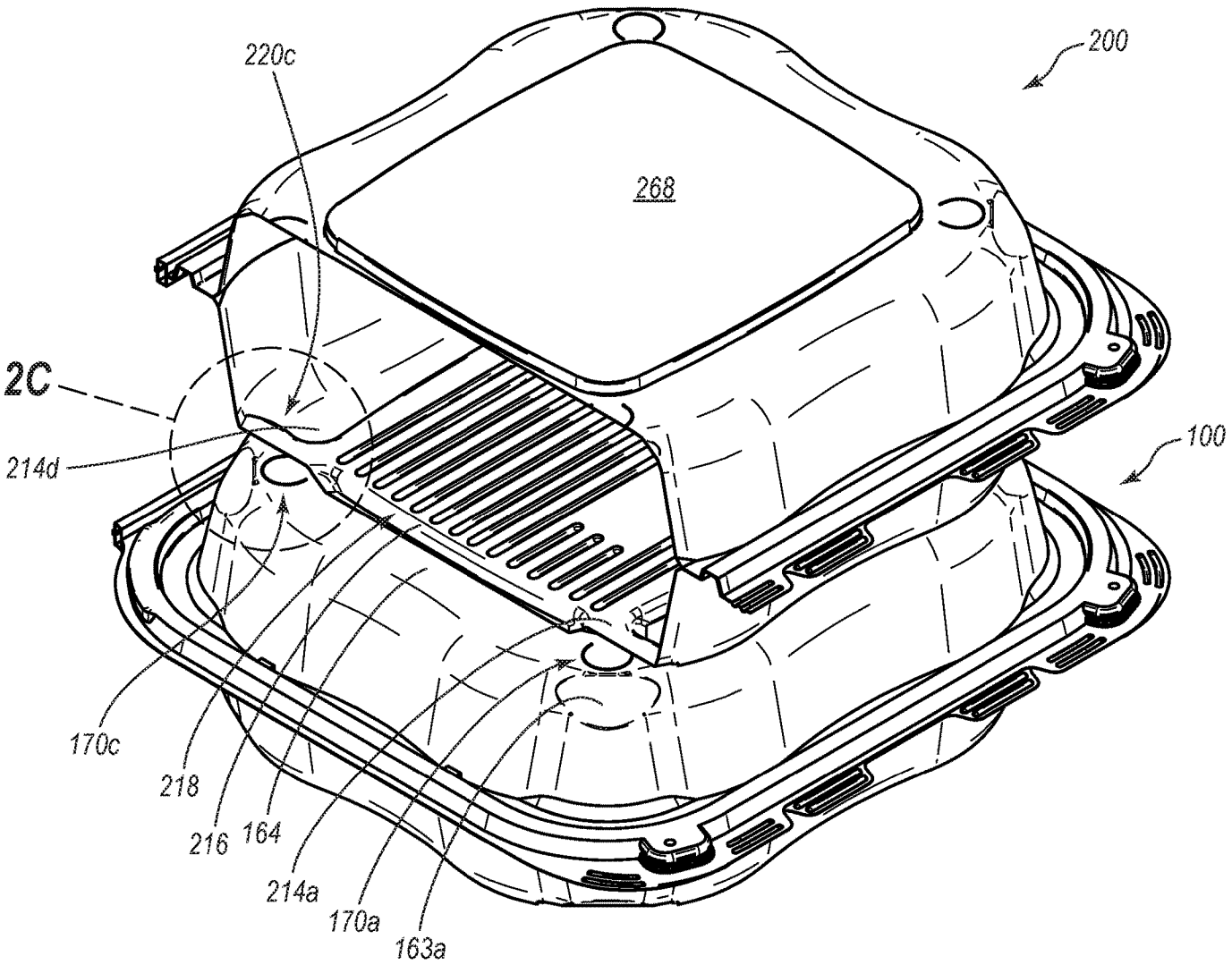
FIG. 2B is a perspective view of a first container in the closed position stacked on a second container in the closed position with a cut-away to show two of the vents of the first container and the corresponding vent portals of the second container.
Figure 3A:
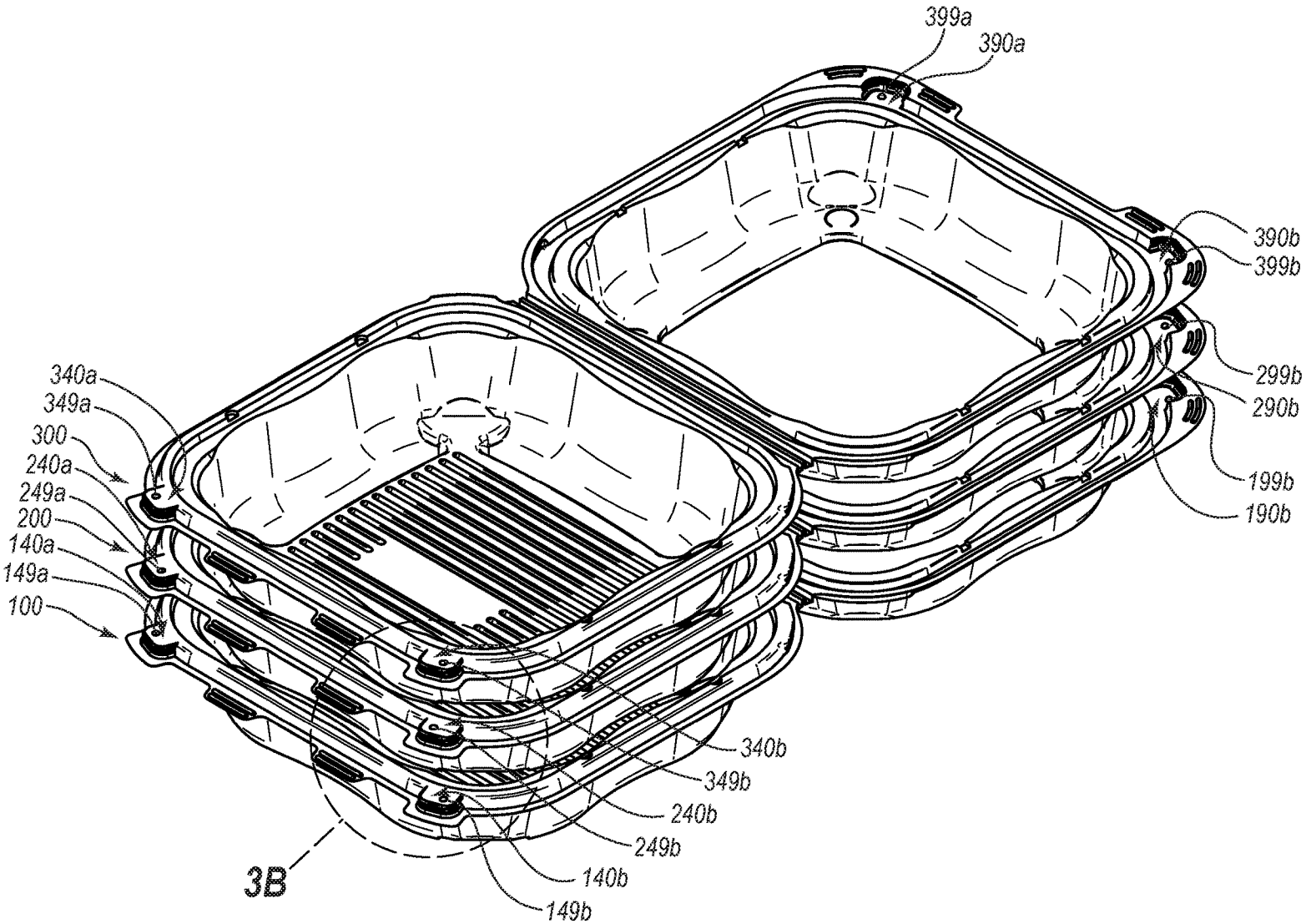
FIG. 3A is a perspective view of three containers as shown in FIG. 1A in an open position, showing the containers positioned to be nested together.
Figure 3B:
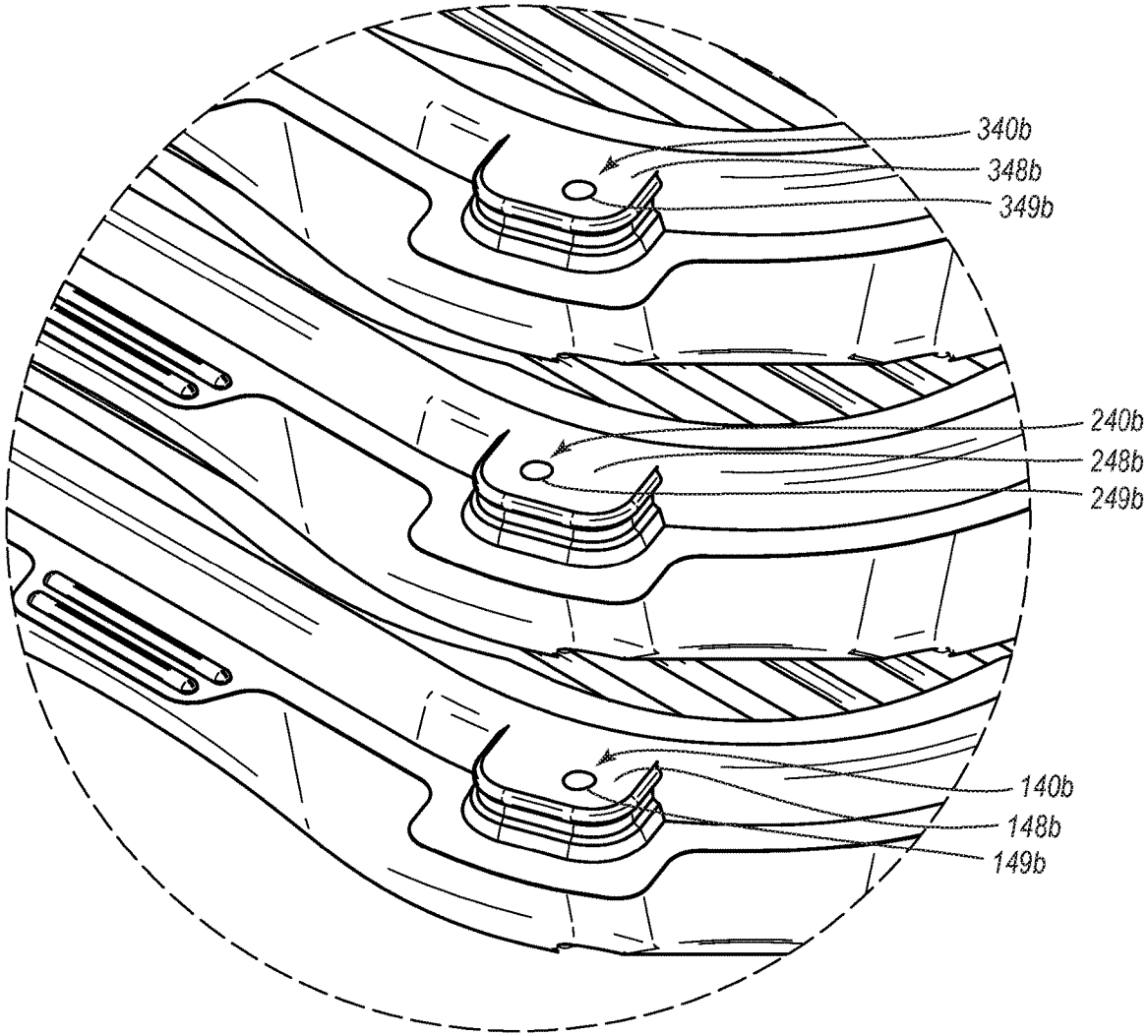
FIG. 3B is an enlarged perspective view of the section encircled at 3A of the containers of FIG. 3A.
Figure 3C:
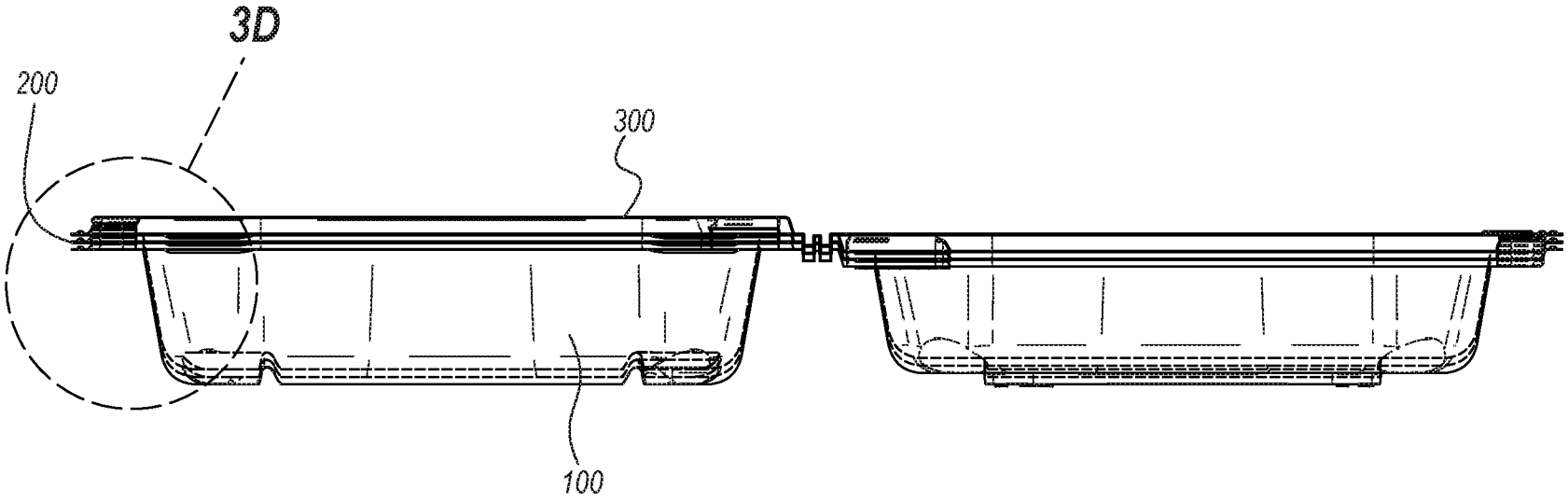
FIG. 3C shows the containers after being compressed towards each other in the nested arrangement.

Certain embodiments of the vented containers as disclosed herein can advantageously be supplied to a user in an open, loosely nested arrangement as shown, for example, in FIG. 3A, or in an open, tightly nested stack as shown in FIG. 3C. The user can load food into the container and can then close the container completely by folding the lid onto the base as shown in FIG. 1B. Additionally, embodiments are disclosed that enable the lid to couple with the base of the container as shown in FIGS. 2A-2B.

Some embodiments of the container may include a vent or multiple vents configured to release heat and/or moisture vapor that may form when a hot item is placed into the container. An end user (e.g., the consumer) can vent warm air from the interior of the container to the external environment even when multiple containers are stacked together. Embodiments of the vented containers are stackable in a closed position. Further details of embodiments of the disclosed containers are provided below.

FIGS. 1A-1G depict a container 100. FIGS. 2A-2D depict closed containers in a stacked arrangement with a container 200 on the container 100. FIGS. 3A-3E depict open containers in a nested arrangement including the container 100, the container 200, and a container 300.

It will be appreciated that the illustrated embodiments may have analogous features. Accordingly, like features are designated with like reference numerals, with the leading digits incremented to "1" or "2". Relevant disclosure set forth above regarding similarly identified features thus may not be repeated hereafter. Containers corresponding with container 100 are also depicted in Design Application Ser. No. 29/695,419 titled Food Container, which is hereby incorporated by reference. Container 200, depicted in FIGS. 2A-3E, is nearly identical with container 100, as described below. Container 300 depicted in FIGS. 3A-3E is identical to container 100. Specific features of the containers and related components shown in FIGS. 2A-3E may not be shown or identified by a reference numeral or specifically discussed in the written description that follows. However, such features may clearly be the same, or substantially the same, as features depicted in other embodiments and/or described with respect to such embodiments. Accordingly, the relevant descriptions of such features of container 100 apply equally to the features of the containers 200 and 300. Any suitable combination of the features, and variations of the same, described with respect to the container 100 and components illustrated in FIG. 1A-1F can be employed with the containers 200 and 300 and their components illustrated in FIGS. 2A-3E, and vice versa. This pattern of disclosure applies equally to further embodiments described hereafter.

FIG. 1A depicts an embodiment of a container 100 shown in an open position with a base 110 and a lid 160 that are connected by a hinge 150. FIGS. 1A-1F depict various details of base 110 and lid 160. The container 100 has a front end 102, a back end 104, a bottom end 106, and a top end 108. The hinge 150 is at the back end 104, which is opposite from the front end 102. When the container 100 is in the closed position, as shown in FIG. 1B, the top end 108 is above the bottom end 106. The bottom end 106 of the container 100 is also the bottom end of the base 110. The top end 108 of the container 100 is also the top end of lid 160.

Figure 1C:
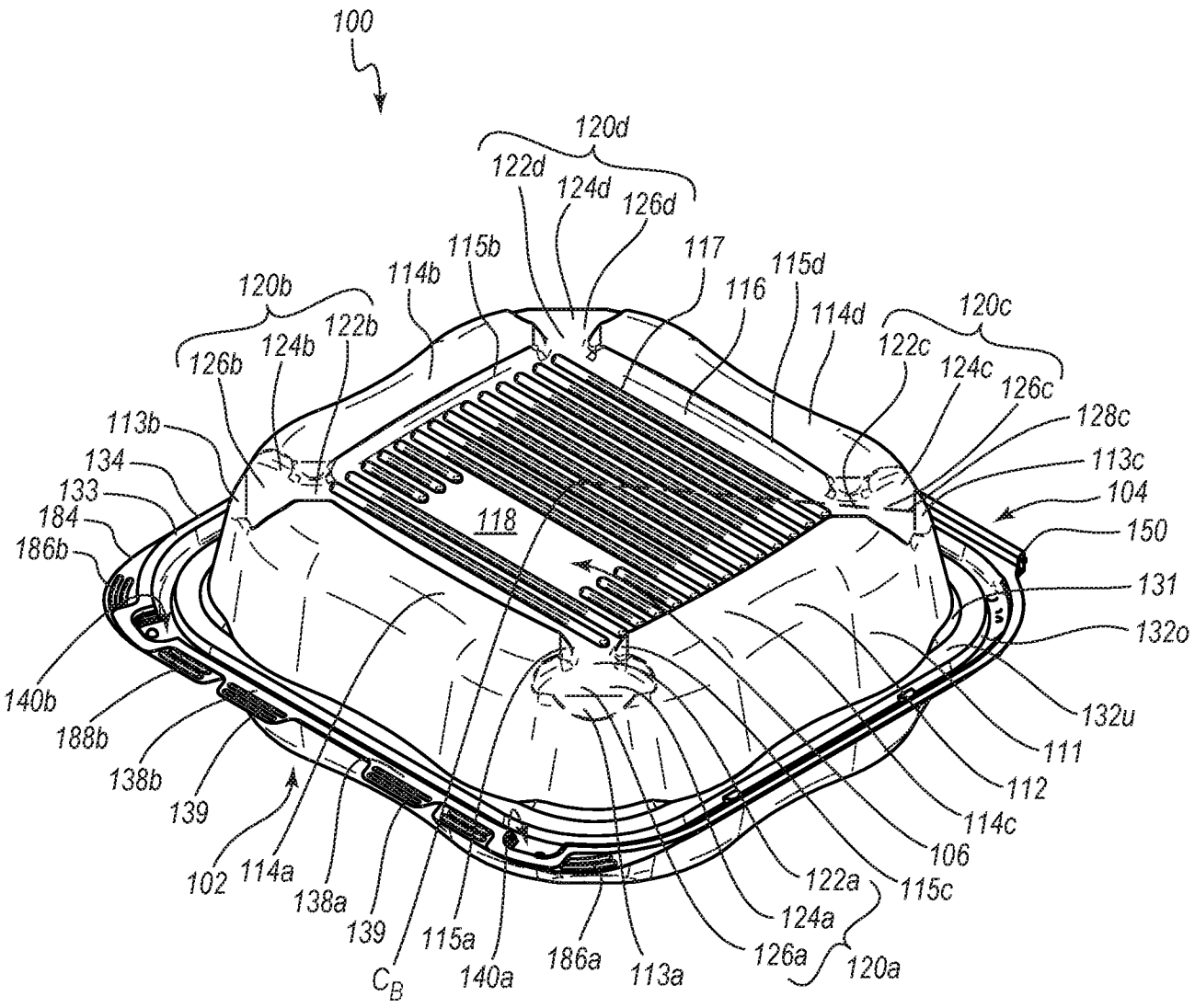
FIG. 1C is a perspective view of the container of FIG. 1B turned upside down to show the configuration of the bottom end of the base when the container is in the closed position.
Figure 1D:
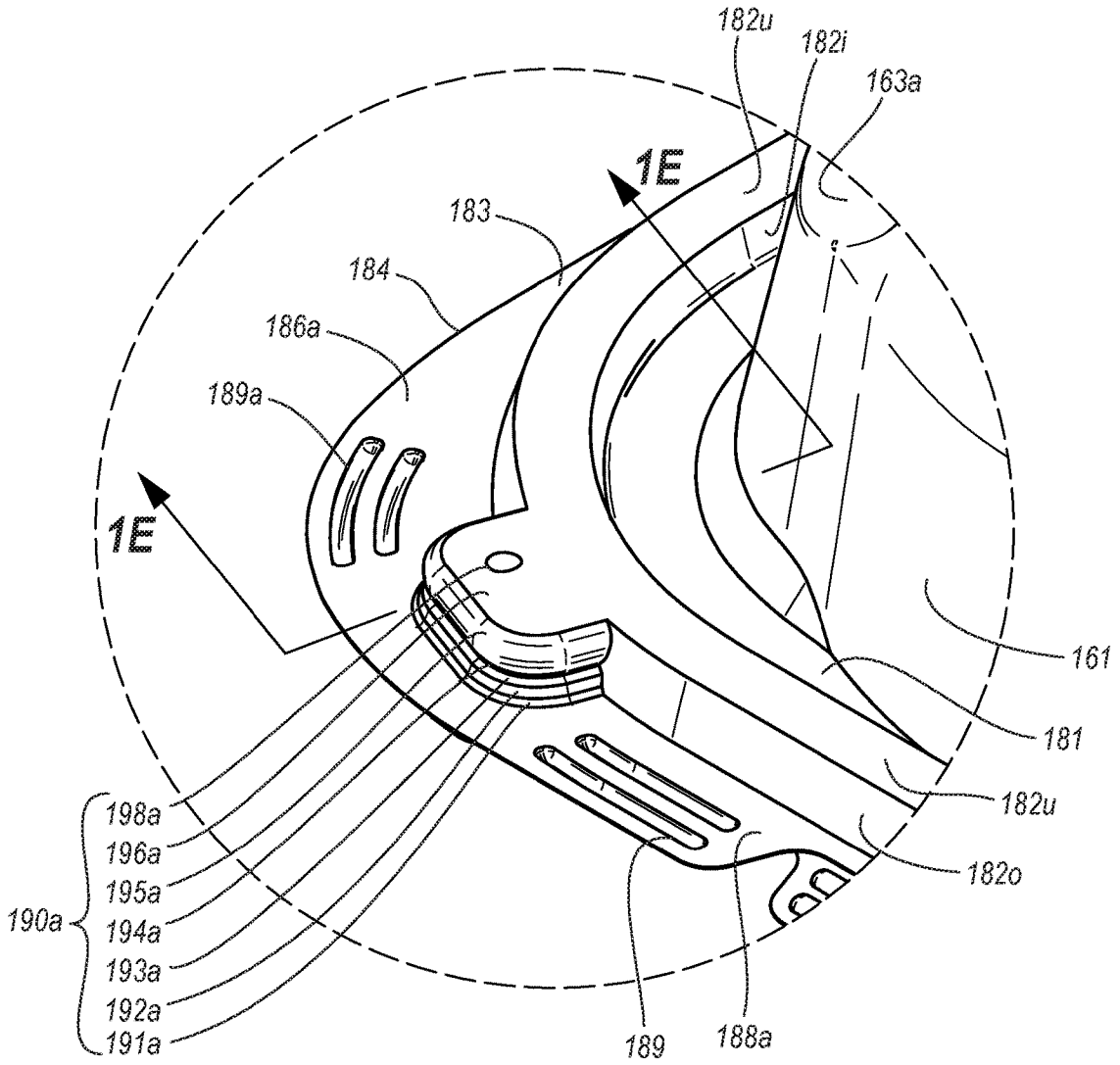
FIG. 1D is an enlarged perspective view of the section encircled at 1D of the container of FIG. 1B.

Some of the other components in the container 100 include vents 170*a-d* in the lid 160 that each cooperate with a vent portal 120*a-d* in the base 110, a pair of locking tabs 140*a-b* of the base 110 that cooperate with a pair of locking covers 190*a-b* of the lid 160. The container 100 also includes a stacking receptacle 118 of the base 110 as shown in FIG. 1C and a stacking protrusion 168 of the lid 160 as shown in FIG. 1B. These elements are described in more detail below.

The containers may have any suitable shapes, such as those that are round, oval, rectangular, and irregular shapes. Additionally, the containers may have any suitable size. For example, the containers may hold volumes ranging from 4 ounces through 64 ounces.

In addition to FIG. 1B, FIG. 1C also depicts the container 100 in a closed position but the container 100 in FIG. 1C is upside down. FIG. 1C shows the base 110 having a center point, $C_B$, which is also the center of the stacking receptacle 118. The base 110 has a base sidewall 111 that transitions to a base shoulder 112 with chamfered corners 113*a-d*. The base shoulder 112 extends to a base platform at the bottom end 106 of the container 100. Because the base shoulder 112 may be considered as part of the base sidewall 111, the base sidewall 111 extends to the base platform.

The base platform comprises base platform segments 114*a-d*. Each of the base platform segments 114*a-d* has an inner wall 115*a-d* that extends to a base face 116. The base face 116 may be configured with ribs 117. The stacking receptacle 118 is defined by the base face 116 and the inner walls 115*a-d* of the base platform segment 114*a-d*. The base platform segments 114*a-d* are not connected to each other but work together to provide a vertical offset as measured from the base face 116 to the tops of the base platform segment 114*a-d*. The depth of the stacking receptacle 118 corresponds to the vertical offset from the tops of the base platform segments 114*a-d* to the base face 116. The vertical offset also corresponds with the height of the inner walls 115*a-d*. The base platform segments 114*a-d* may have lengths and shapes such that the base face 116 is rectangular or a square, as shown. The base platform 114, base face 116, and stacking receptacle 118 can have any suitable shape and configuration. For example, the base 110 and/or stacking receptacle 118 may be square in shape with rounded corners, as shown. The stacking receptacle 118 is an example of a stacking structure, as further discussed below with reference to FIGS. 2A-2B.

As shown in FIG. 1C, vent portals 120*a-d* are positioned at the corners of bottom end 106 of base 110. Each vent portal is at least partially located in the shoulder 112. Each vent portal 120*a-d* has a neck as shown at 122*a-d* that extends to a mouth as shown at 124*a-d*. Each neck 122*a-d* extends from the base face 116. Each mouth 124*a-d* has a wider width relative to the corresponding neck 122*a-d*. The mouths 124*a-d* are in the base shoulder 112 and are each radially outward relative to the corresponding neck. Each vent portal 120*a-d* has a ceiling as shown at 126*a-d*. The ceilings 126*a-d* may have the same vertical offset as measured to the tops of the base platform segments 114*a-d* as the vertical offset as measured from the base face 116 to the tops of the base platform segments 114*a-d*. Each vent portal 120*a-d* is defined by a ceiling 126*a-d* and a pair of walls of the two adjacent base platform segments. The pair of walls defining vent portal 120*a* are walls 115*a* and 115*c*. The pair of walls defining vent portal 120*b* are walls 115*a* and 115*b*. The pair of walls defining vent portal 120*c* are walls 115*c* and 115*d*. The pair of walls defining vent portal 120*d* are walls 115*b* and 115*d*. Each neck and mouth may be considered as zones of each vent portal wherein the inner walls 115*a-d* transition from a narrow width to a wider width. Each vent portal 120*a-d* is configured such that each neck 122*a-d* is positioned more inward toward the center point of the base, $C_B$, relative to the corresponding mouth while each mouth 124*a-d* is oriented outward away from the center point of the base, $C_B$. Each mouth 124*a-d* is adjacent to and between two sections of shoulder 112. Additionally, each mouth 124*a-d* transitions to and is adjacent to a base chamfered corner as shown at 113*a-d*.

Figure 1E:
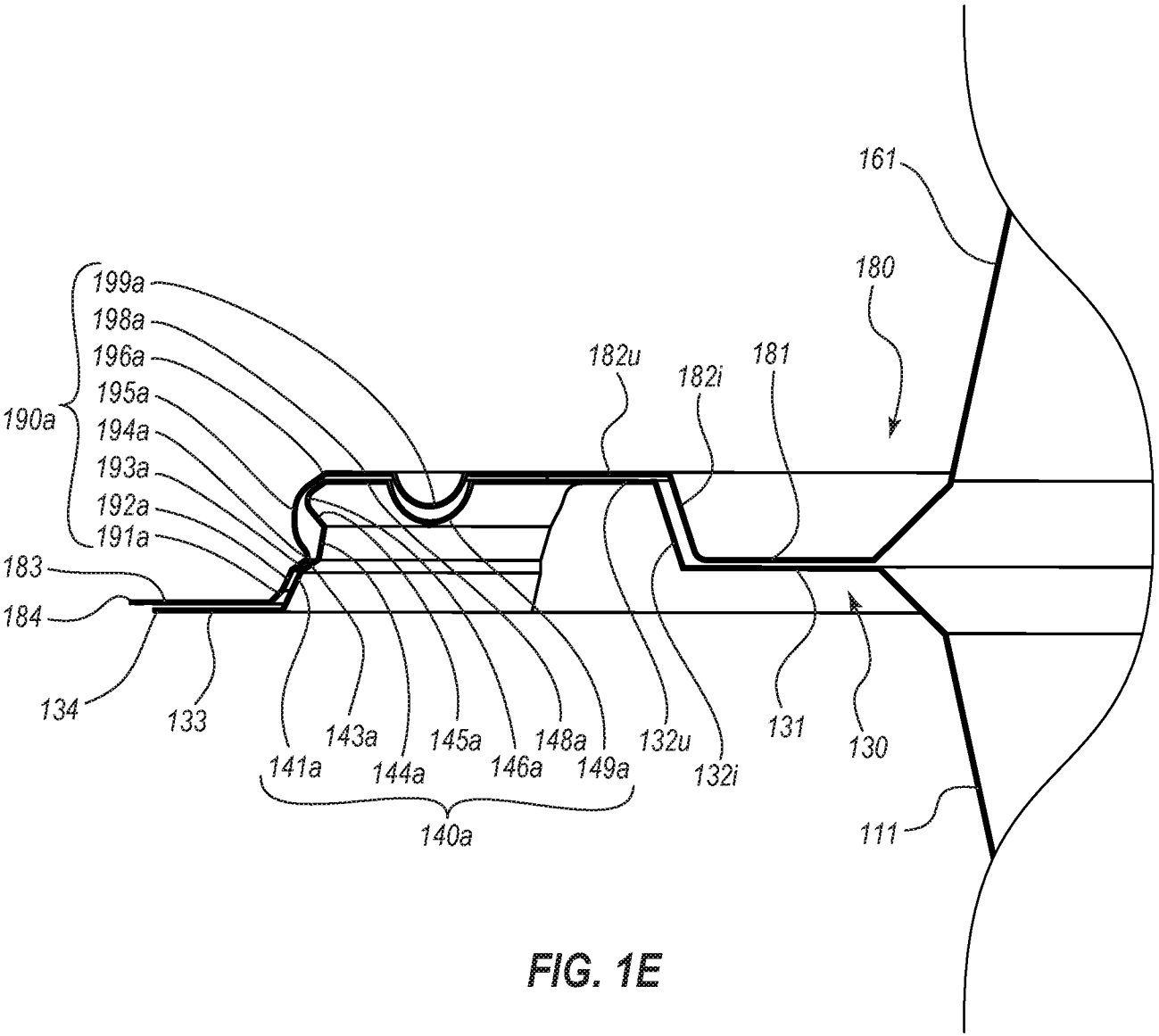
FIG. 1E is a cross-sectional view of the lid and the base of the containers of FIG. 1D taken along cutting line 1E-1E of FIG. 1D to show the locking cover of the lid over the locking tab of the base.

As shown in FIGS. 1A and 1E, the base 100 has a base brim 130. The base brim 130 extends from the base sidewall 111, which extends upward from the bottom end 106. As shown in FIGS. 1A, 1C, and 1E, the base brim 130 includes a base rim 131. The base rim 131 extends between the base sidewall 111 and a raised connection interface 132. A base flange 133 extends from the raised connection interface 132 and extends radially outward from the bottom of the locking tab 140*a*. The base flange 133 terminates at a free edge 134. The base brim 130 thus comprises the base rim 131, the raised connection interface 132, and the flange 133.

As shown in FIG. 1A and FIGS. 1E-1G, the raised connection interface 132 includes an inner wall 132*i*, an upper wall 132*u*, and an outer wall 132*o*. The outer wall 132*o* extends to the flange 133. The flange 133 extends radially outward from outer wall 132*o* with an orientation that is perpendicular relative to a center longitudinal axis of the container extending through center point, $C_B$. Stated otherwise, the flange 133 extends horizontally outward relative to the center point, $C_B$. The flange 133 is shown extending around the base 110 up to the hinge 150.

Figure 1F:
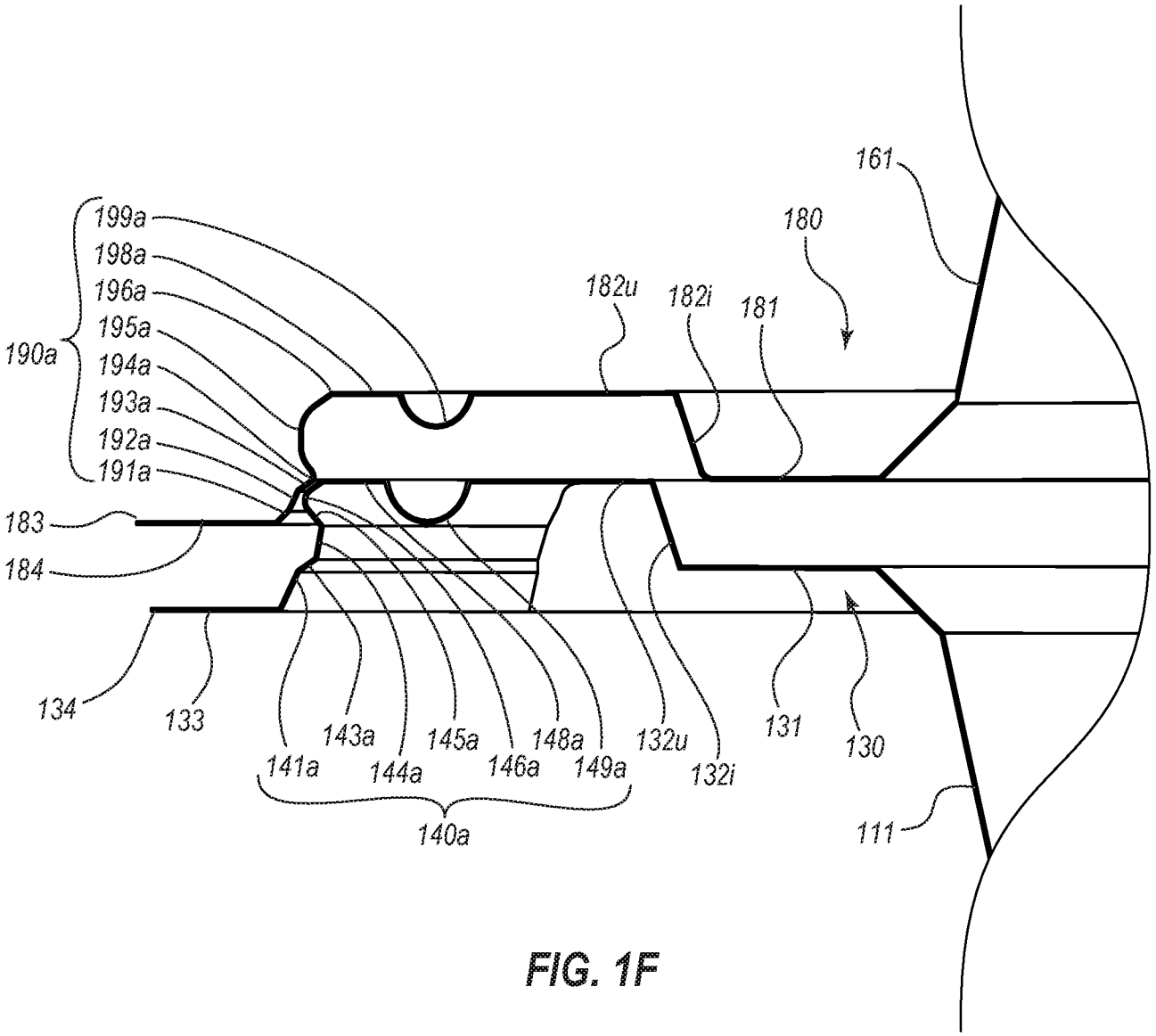
FIG. 1F is a cross-sectional view of the lid and the base of the containers of FIG. 1E to show the locking cover of the lid moving relative to the locking tab of the base.
Figure 1G:
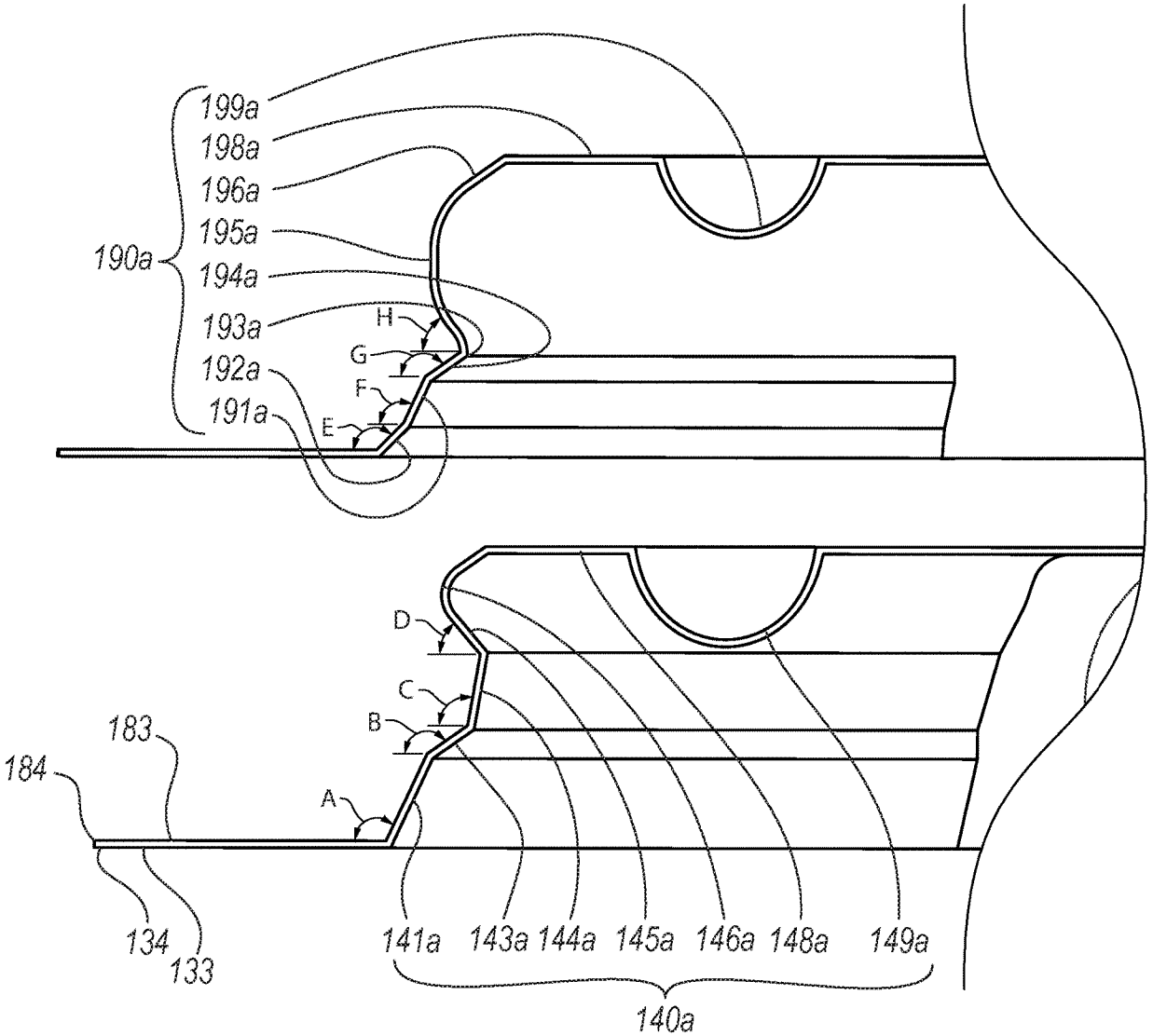
FIG. 1G is a cross-sectional view of the lid and the base of the containers of FIG. 1F showing the locking cover of the lid separated from the locking tab of the base.

The flange 133 extends around locking tabs 140*a-b*, as best seen in FIG. 1A. More specifically, as shown in FIGS. 1E-1G, the flange 133 extends from the bottom sections 141*a* of the locking tab 140*a* and also from the bottom section 141*b* (not shown) of the locking tab 140*b*. The flange 133 also extends between the locking tabs 140*a-b*. Additionally, the flange 133 also extends from the outer wall 132*o* of the base connection interface 132 around the circumference of the base 110 to the hinge 150. The flange 133 may have a length of several millimeters such as 1-5 mm or about 3 mm.

The grasping tabs 138*a-b* extend from the flange 133 at the front 102 of the container 100 between the locking tabs 140*a-b*. Each grasping tab 138*a-b* extends from the flange 133 with a length that is sufficient for it to be easily grasped. For example, each grasping tab 138*a-b* has a length of 5-12 mm. The grasping tabs 138*a-b* may extend in the same plane as the flange 133 such that the grasping tabs 138*a-b* are perpendicular with respective to the center longitudinal axis and are horizontal when the container is in a closed position. The grasping tabs 138*a-b* may have optional raised surfaces such as the ribs 139 to make it easier to grasp the grasping tabs 138*a-b*. Alternatively, the raised surfaces may comprise text such as "PULL" or "LIFT" to indicate the direction in which the grasping tabs 138*a-b* are to be moved.

The pair of locking tabs 140*a-b* extend from the base connection interface 132 near the corners of the front 102 of the container 100 as shown in FIG. 1A. Each locking tab 140*a-b* has a face between its bottom and its top and each face comprises a plurality of locking segments. The locking segments and other components of the locking tab 140*a* are shown in FIGS. 1E-1G. The locking segments and other components of locking tab 140*b* are identical to those of the locking tab 140*a* but are not depicted in the enlarged view of FIG. 1D. The locking segments and other components of locking tab 140*b* are the same as those of the locking tab 140*a*. The locking segments of the locking tab 140*a* include, starting at the bottom of the locking tab 140*a*, a bottom section 141*a*, a tab shoulder 143*a*, a neck 144*a*, and a head 145*a*. The head 145*a* has a nose 146*a* that extends outward about as far outward as the tab shoulder 143*a*. Each locking tab 140*a-b* further comprises a flat top 148*a-b* with a base indentation 149*a-b*. Each base indentation 149*a-b* has a top surface that acts as a recess and a bottom surface that acts as a bump. The interaction of elements of the locking tab 140*a-b* with corresponding elements of the locking cover 190 *a-b* of the lid 160 are described below after the elements of the locking cover 190*a-b* are introduced in detail. Like the locking tabs 140*a-b*, each locking cover 190*a-b* has a face between its bottom and its top and each face comprises a plurality of segments. When container 100 is in the closed position, the lid indentation 199*a* is in the base indentation 149*a* and a segment of the face of the locking cover 190*a* rests on a segment of the face of the locking tab 140*a*.

As shown in FIG. 1G, the bottom section 141 extends radially inward and upward from the flange 133 at an angle A, which is slightly obtuse such as an angle ranging from 95°-115°. The tab shoulder 143*a* extends radially inward from the bottom section 141*a* at an angle B relative to a plane parallel to the flange 133 that is more obtuse than angle A. Angle B may range from 100°-135°. The neck 144*a* extends upward from the tab shoulder 143*a* at an angle C relative to a plane parallel to the flange 133. Angle C is just slightly obtuse such as an angle ranging from 91°-105°. The neck 144*a* has a greater length than the tab shoulder 143*a* but has a shorter length than the bottom section 141*a*. The head 145*a* extends upward from the neck 144*a* and radially outward to a curved nose 146*a* and then radially inward from the curved nose 146*a* to the flat top 148*a*. As best seen in FIGS. 1E-1F, the flat top 148*a* extends to the upper wall 132*u* of the connection interface 132. As shown in FIG. 1A, the segments of each locking tab 140*a-b* extend to the outer wall 132*o* of the connection interface 132 including the bottom sections 141*a-b*, the tab shoulders 143*a-b*, the necks 144*a-b*, and the heads 145*a-b*.

The hinge 150 may be made from any suitable material that allows for rotation of the lid 160 and the base 110 relative to each other. In some embodiments, the hinge 150 may be made from the same piece of material that the base 110 and the lid 160 are made from. The base 110, the hinge 150, and the lid 160, may all be formed from a unitary piece of material. The width and height of the hinge 150 may vary to accommodate different configurations of the base and the lid. As used herein, the width of a hinge refers to the length along the perimeter of the container 100. The height of the hinge is perpendicular to the width of the hinge.

As shown in FIG. 1B, the lid 160 has a center point, $C_L$, which is also the center of the stacking protrusion 162. Center point, $C_L$, may be coaxial with the center point of the base, $C_B$, such that the centers $C_L$ and $C_B$, are points along the center longitudinal axis of the container. As also shown in FIG. 1B, the lid 160 has a lid sidewall 161 that extends to a lid shoulder 162. The lid shoulder 162 has chamfered corners 163*a-d* in the lid sidewall 161 below each C-shaped vent 170*a-d* when the container 100 is in the closed position. The lid shoulder 162 extends to a lid platform 164. Because the lid shoulder 162 may be considered as part of the lid sidewall 161, the lid sidewall 161 extends to the lid platform 164 at the top end 108 of the container 100.

FIG. 1B shows the lid platform 164 extending around the stacking protrusion 168. Stacking protrusion 168 has a wall 165 and a lid face 166. The wall 165 extends from and is surrounded by the lid platform 164. The wall 165 extends perpendicularly upward to the lid face 166. The stacking protrusion 168 is defined by the wall 165 and the lid face 166. The stacking protrusion 168 has a height that is the same as the height of the wall 165. Stated otherwise, the height of stacking protrusion 168 is the vertical offset from the lid platform 164 to the lid face 166. The stacking protrusion 168 is another example of a stacking structure, as further discussed below with reference to FIGS. 2A-2B.

The lid of embodiments of the vented container disclosed herein includes a stacking structure, such as a stacking protrusion, that is configured to be mated with a stacking structure of another container to permit the container to be vertically stacked together with other containers. The lid platform 164, lid face 166, and the stacking protrusion 168 can have any suitable shape and configuration. For example, the lid 160 and/or stacking protrusion 168 may be square in shape with rounded corners, as shown, with each side of the stacking protrusion 168 having a length that is the same. In the depicted embodiments, the lid 160 comprises a stacking protrusion 168 that is vertically offset from the lid platform 164 in an outward direction. In an alternative embodiment, the stacking structure may be a stacking receptacle that is vertically offset relative to the lid platform in an inward direction. The lid platform extends at least partially around a lid stacking structure and may extend around a majority, such as around all, of the lid stacking structure.

The stacking structures on either the lid or base, may be slightly offset from the stacking structure on the cooperative base or lid of an adjacent container, which permits the containers to be stably stacked upon a planar surface. Additionally, the stackable protrusion 168 of the lid 160 may have a circumference only slightly smaller than the circumference of the stacking receptacle 118 of base 110 thereby enabling the containers to be packed tightly together when closed, as discussed in more detail below with reference to FIGS. 2A-2B. For example, the stacking receptacle 118 of the base 110 may be wider from the front to the back of the container and from side to side than the stackable protrusion 168 of lid 160. A stack may be designed to be sufficiently tightly packed together such that a container stacked on another is resistant to separation even after the stack is tipped on its side. The stacking protrusions and receptacles enable closed containers to be stacked as shown in FIGS. 2A-2D in a stacked arrangement with the stacking protrusion 168 of the lid 160 fitting within the stacking receptacle 218 of the base 210 of a second container 200 while the stacking receptacle 218 of the base 210 fits with a stacking protrusion of a lid of a third container.

Figure 2D:
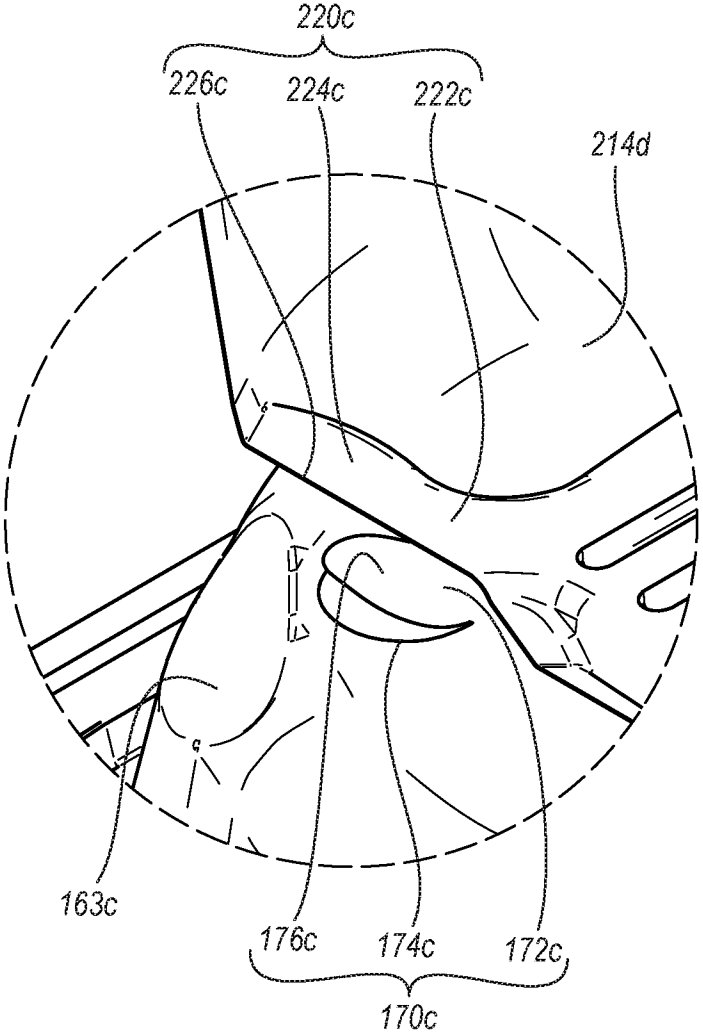
FIG. 2D is an enlarged perspective view corresponding to the enlarged perspective view of FIG. 2C but showing the C-shaped vent in the open configuration with the flap separated from the surrounding lid platform.
Figure 2C:
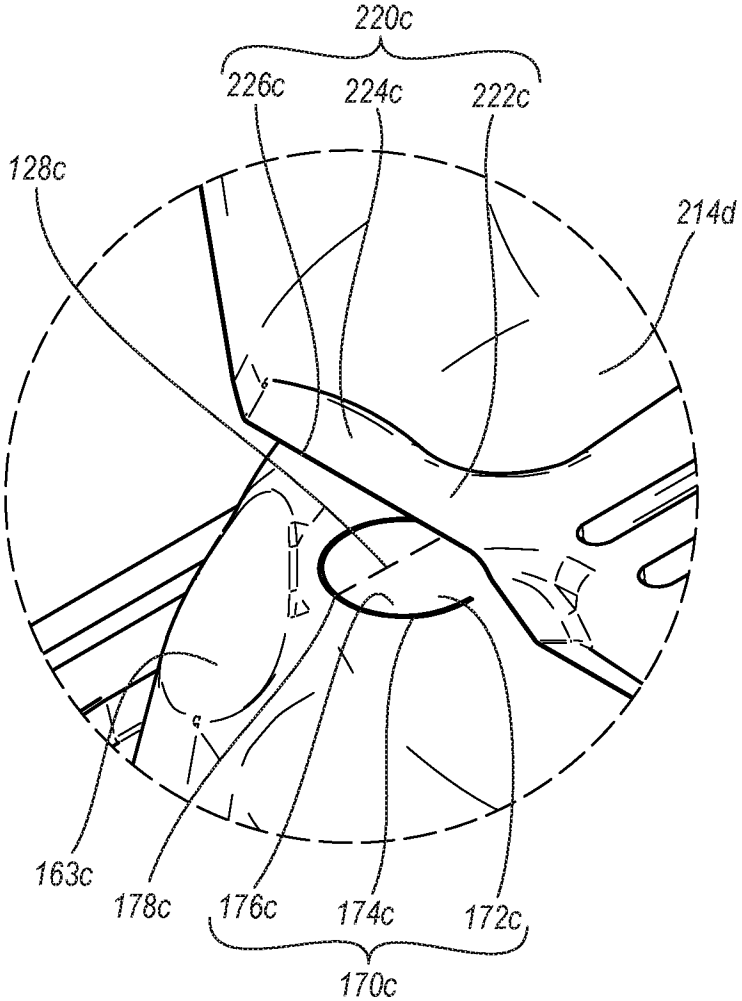
FIG. 2C is an enlarged perspective view of the section encircled at 2C of the containers of FIG. 2B showing a vent in a closed configuration.

As best seen in FIG. 1B, the vents, such as the C-shaped vents 170*a-d*, are positioned at the corners of the lid 160 in the lid platform 164. Each of the C-shaped vents 170*a-d* has a connecting portion as shown at 172*a-d* that connects the flap with the surrounding region of the lid platform 164. A weakened line as shown at 174*a-d* in the lid platform 164 that temporarily connects the vent flap as shown at 176*a-d*. Each vent flap is defined by a weakened line in the lid platform when the vent is in a closed configuration. Each C-shaped vent 170*a-d* is moved from a closed configuration as shown in FIG. 1B and FIGS. 2B-2C to an open configuration as shown in FIG. 2D by applying pressure to the vent flap 176*a-d* until the weakened line 174*a-d* tears. After the weakened line 174*a-d* tears then the vent flap 176*a-d* remains connected to the lid platform 164 via the connecting portion 172*a-d* like a swinging chad.

The lid brim 180 of the lid 160 is best seen in FIG. 1B. The lid brim 180 has shapes corresponding to the shapes of base brim 130 of base 110. The lid brim 180 includes a brim trough 181, a lid connection interface 182, a lid flange 183, and a lid free edge 184. The lid connection interface 182 may be raised as shown to fit in a mated configuration with the base connection interface 132, which has a recessed profile. The lid connection interface 182 has an inner wall 182*i*, an upper wall 182*u*, and an outer wall 182*o*. At least one of the inner wall 182*i*, the upper wall 182*u*, and the outer wall 182*o* abuts the corresponding inner wall 132*i*, upper wall 132*u*, and outer wall 132*o* of the base connection interface 132 to form a seal. The brim trough 181 and the lid connection interface 182 may extend at least partially around the lid 160 or entirely around the lid 160 as depicted. The lid flange 183 extends from the outer wall 182*o* of the lid connection interface 182 and terminates at the free edge 183.

As best seen in FIGS. 1A-1D, the outer grasping tabs 186*a-b* and the inner grasping tabs 188*a-b* extend from the lid flange 184. The grasping tabs 186*a-b* and 188*a-b* may have optional raised surfaces such as ribs 189 to make it easier to grasp the grasping tabs 186*a-b* or 188*a-b*. Alternatively, the raised surfaces may comprise text such as "PULL" or "LIFT" to indicate the direction in which the grasping tabs 186*a-b* or 188*a-b* are to be moved. Each pair of outer and inner grasping tabs appear respectively on the outer and inner sides of a locking cover as shown at 190*a-b*. Thus, outer grasping tab 186*a* is on the outer side of locking cover 190*a* and the inner grasping tab 190*a* is on the inner side of locking cover 190*a*. Similarly, the outer grasping tab 186*b* is on the outer side of the locking cover 190*b* and the inner grasping tab 190*b* is on the inner side of locking cover 190*b*.

As shown in FIGS. 1E-1G, the locking cover 190*a* comprises a plurality of segments including a lower arm 191*a*, an upper arm 192*a*, a cover shoulder 193*a*, a bend 194*a*, and an arched section 195*a*. As also shown in FIGS. 1E-1G, the locking cover 190*a* further comprises a pivot 196*a* and a flat top 198*a* with a lid indentation 199*a*. Each lid indentation 199*a-b* has a top surface that acts as a recess and a bottom surface that acts as a bump.

The segments and other components of the locking cover 190*b* are identical to those of the locking cover 190*a* but are not depicted in an enlarged view so only the segments and other components of the locking cover 190*a* are described with reference to the figures. The pair of locking covers 190*a-b* extend from the connection interface 182 near the corners of the front 102 of the container 100 as shown in FIGS. 1A-1B and 1D-1G.

A lower arm 191*a* extends radially inward and upward from the flange 183 at an angle E, which is slightly obtuse such as an angle ranging from 95°-115°. Upper arm 192*a* extends radially inward from lower arm 191*a* at an angle F relative to a plane parallel to the flange 133 that is less obtuse than angle E. Angle E is slightly more obtuse than angle A and angle F. The upper arm 192*a* is essentially parallel to the respective bottom section 141*a* when the locking cover 190*a* is positioned over the locking tab 140*a*. The cover shoulder 193*a* extends radially inward from the upper arm 192*a* at an angle G that is about the same as angle B such that the cover shoulder 193*a* is essentially parallel to the respective the tab shoulder 143*a* when the locking cover 190*a* is positioned over the locking tab 140*a*. While the bend 194*a* is essentially rounded, a lower portion of the arched section 195*a* extends radially outward and defines an angle H. Angle H is acute and ranges from 45°-80°. The arched section 195 curves annually outward from its lower portion and then curves annually inward to the pivot 196*a*.

FIG. 1E shows the locking cover 190*a* covering the locking tab 140*a* in a locked position with the lid indentation 199*a* extending into the base indentation 149*a* and the cover shoulder 193*a* engaging the tab shoulder 143*a*. The lid indentation 199*a* of the first container 100 fits within the base indentation 149*a* of the first container 100 when the first container 100 is in the closed position. At least one segment of the face of the locking cover 190*a* of the first container 100 engages at least one segment of the face of the locking tab 140*a* of the first container 100 to releasably lock the base 110 and the lid 160 together when the first container 100 is in the closed position.

FIG. 1E also shows the close tolerance between the lid flange 183 and the base flange 133. There is also a close tolerance between the brim trough 181 and the base rim 131 while there is a greater separation between the inner wall 182*i* of the lid connection interface 182 and the inner wall 132*i* of the base connection interface 132.

FIGS. 1F-1G show the locking cover 190*a* after it has been lifted off the locking tab 140*a* such that they are no longer in a locked position. The locking cover 190*a* is moved to the unlocked position by flexing the locking cover 190*a* at the pivot 196*a* and along the arched section 195*a* to permit the bend 194*a* to move over the nose 146*a* of the head 145*a*.

FIGS. 2A-2D depict the second container 200 on the first container 100 in a stacked arrangement with the containers in the closed position. More particularly, the stacking protrusion 168 (not shown in FIGS. 2A-2D) of the lid 160 of the container 100 is positioned in the stacking receptacle 218 (shown in FIG. 2B) of the base 210 of container 200.

FIG. 2A shows that when the containers are in the closed position, the lid stacking structure of the first container 100 may be mated with the base stacking structure of the second container 200 to permit the second container 200 to be stacked on the first container 100 in a stacked arrangement with the vent portal, such as 220*c*, of the second container 200 over the vent 170*c* of the first container 100. A primary benefit of the stacked arrangement is that the vent portal 170*c* enables the vent 220*c* to be in an open configuration such that heat and/or moisture may be vented from the first container 100 despite being stacked under the second container 200. Because the number of vent portals equals the number of vents, each vent enables heat and/or moisture to be vented. Also, this venting is possible because of the structures of the container 100 and container 200, which are identical with respect to their vents and vent portals. For example, vents 120*a* and 120*c* of the first container 100, as shown in FIG. 2A, are respectively directly above vent portals 170*a* and 170*c*; and, as also shown in FIG. 2A, vents 220*a* and 220*c* of the second container 200 are respectively directly above vent portals 270*a* and 270*c* with identical structures.

FIG. 2A depicts a length, $L_1$, which is the height of the stacking protrusion 168 at the lid face 166 relative to the lid platform 164 and the depth of the stacking receptacle 218 at the base face 216 relative to the base platform segments 214 *a-d* (note that only 214*a* and 214 *d* are shown in FIGS. 2B-2D). Because the height and depth are essentially the same, the base platform segments 214 *a-d* are able to rest on the lid platform 164. Of course, the same result may be achieved when the height of the stacking protrusion 168 at the lid face 166 relative to the lid platform 164 is somewhat less than the depth of stacking receptacle 218 at the base face 216 relative to the base platform segments 214 *a-d*.

As explained above, the stacking structures may have any suitable shape and configuration, such as the elevated rectangular platform in the lid and the recessed rectangular indentation in the base of the container 100 depicted in the figures. For example, the stacking structures may have four sides to form a rectangular shape. The stacking structures may have rounded corners. In certain embodiments, the stacking protrusion has a rectangular shape and rounded corners, as depicted. The stacking structures may have other shapes such as an elliptical or round shape.

In the depicted embodiments, the base 110 comprises a stacking receptacle 118 that is vertically offset from the base platform 114 in an inward direction. In an alternative embodiment, the stacking structure of the base may be a stacking protrusion that is vertically offset relative to the lid platform in an outward direction. The base platform may extend at least partially around the base stacking structure or around a majority, such as around all, of the base stacking structure.

Both the stacking protrusion and the stacking receptacle may be vertically offset from the end of the container to which they abut, including being vertically offset from a lid and/or base platform. For example, the stacking structure may be vertically offset from the lid and/or base platform by between about 1 and about 10 mm.

As explained above, a container may be vertically stacked together with other containers because the base of embodiments of the vented container disclosed herein includes a stacking structure, such as a stacking receptacle, that is configured to be mated with a stacking structure of another container. However, the cooperating stacking structures, such as a stacking protrusion 168 on the lid 160 of a first container and a stacking receptacle 218 on the base 210 of a second container 200, may also interact to permit a stable and well-aligned (or vertically straight) stack to be formed as shown in FIGS. 2A-2B. The interaction may include a tightly fitting cooperating stacking structures together, or by having a rimmed edge of one structure click into an indentation in the cooperating structure. The lid stacking structure, in an embodiment, may fit in a friction-fit configuration with a base stacking structure of another container.

In some embodiments, the friction-fit is strong enough that some force must be applied to separate them, such as by manual separation by hand. The friction-fit may be strong enough that multiple containers, such as at least two, may be vertically stacked on top of each other to form a stable stack. For example, a plurality of closed containers, such as at least three, may be vertically stacked together such that the base stacking structure of the first container is mated with the lid stacking structure of the second container, and the base of the second container may be mated with the lid stacking structure of the third container such that the containers may be positioned in a stacked arrangement. In an embodiment, a first container has a lid having a stacking protrusion that fits into a friction-fit configuration with a stacking receptacle of a base of a second container, and the stacking receptacle of the base fits into a friction-fit configuration with a stacking protrusion of a lid of a third container. This arrangement is particularly advantageous when moving multiple stacked containers such as in a vehicle.

Each of the vents 170*a-d* is configured to permit heat and/or moisture to be vented from the interior volume of the container to the external environment even when a second container 200 is stacked on the top end 108 of the lid 160. Heat and/or moisture may thus be vented from the interior volume via each of the vents 170*a-d* when the container 100 is closed and a second closed container 200 is stacked on the top end 108 of the lid 160.

FIGS. 2C-2D are enlarged views depicting the vent portal 120*c* and the vent 170*c*. The vent 170*c* is closed in FIGS. 2A-2C and is open in FIG. 2D. The vent 170*c* is opened by applying pressure to the vent flap 176*c* until the weakened line 174*c* tears such that the vent flap 176*c* is oriented upwards as shown in FIG. 2D. Because of the vertical space between each vent flap and its corresponding vent portal, the vent flap may be pivoted upward without interference from the corresponding ceiling as shown in FIG. 2D by the space between the vent flap 176*c* and the ceiling 126*c*.

Each vent portal has an axis extending through its center to $C_B$ as exemplified by the axis 128*c* shown in FIG. 1C and FIG. 2C extending through vent portal 120*c*. Each vent has an axis extending through its center to $C_L$ as exemplified by the axis 178*c* shown in FIG. 1B and FIG. 2C extending through the vent 170*c*. The axis 128*c* and axis 178*c* are coaxial as shown in FIG. 2C.

The vents may be present in the container 100 as shown as a set of four vents 170*a-d* in lid platform 164 in FIG. 1B. However, in an embodiment, the container includes only one vent, only two vents, or some other number of vents. The number and location of the vent or vents on a container may vary depending upon the intended food products to be packaged and/or the size of the container.

The mechanical stability of the container is not compromised by each vent 170*a-d*, even when multiple closed containers are stacked vertically together and vents 170*a-d* are open. When two closed containers having stacking structures are stacked vertically, such as is illustrated in FIGS. 2A-2B, the placement of vents 170*a-d* at the corners of lid platform 164 permit the contents of the containers to remain vented while stacked, as the vents are not covered up or otherwise obstructed despite being in a stacked arrangement. When stacked, neither the stacking receptacle 218 nor base platform segments 214*a-d* of the base 210 of the container adversely affect the vents 170*a-d* of the container 100, and the contents of the container 100 can continue venting.

FIGS. 3A-3E show containers 100, 200, and 300 in a nested configuration. The container 100 has locking tabs 140*a* and 140*b* in which the base indentations 149*a* and 149*b* are on the exterior side of the locking tabs. The container 100 also has locking covers 190*a* and 190*b* in which the lid indentations 199*a* and 199*b* are also on the exterior side of the locking tabs to facilitate locking between the corresponding locking tab and locking cover. The container 200 has the opposite configuration relative to the container 100 because the base indentations 249*a-b* are on the interior side of the respective locking tabs 240*a-b* and the lid indentation 299*a* (not shown) and the lid indentation 299*b* are respectively on the interior side of the locking cover 290*a* (not shown) and the locking cover 290*b*. The container 300 has the identical configuration as container 100. The container 300 thus has base indentations 249*a-b* on the exterior side of the respective locking tabs 240*a-b* and the lid indentations 399*a-b* on the exterior side of the respective locking covers 390*a-b*. Stated more generally, the base indentation in each locking tab of the first container is located at either an exterior side of the top or an interior side of the top of the locking tab of the first container, and the base indentation of the locking tab of the second container is located at either an exterior side of the top or an interior side of the top of the locking tab of the second container that is an opposite side relative to the location of the base indentation of the first container. Thus, when the containers are in the open position and are in a nested arrangement with the base 210 of the second container 200 nested in the base of the first container 100, the base indentation 149*a-b* in the top of the locking tab 140 *a-b* of the first container 100 is not aligned with the base indentation 249*a-b* in the top of the locking tab 240*a-b* of the second container, whereby spacing is maintained between the top of the locking tab 140*a-b* of the first container 100 and the top of the locking tab 240*a-b* of the second container 200 to facilitate separation of the second container 200 from the first container 100. The same applies to the base 310 of the third container 300 nested in the base 210 of the second container 200.

FIG. 3A shows the containers 100, 200, and 300 lightly stacked together as the containers have not been compressed together. Lids 160, 260, 360 are sized and shaped such that when the containers 100, 200, and 300 are in a nested arrangement with the base 310 of the third container 300 in the base 210 of the second container, and the base 210 of the second container 200 nested in the base 110 of the first container 100 then the lids are also nested together with lid 360 of the third container 300 nested in the lid 260 of the second container 200, and the lid 260 of the second container 200 nested in the lid 160 of the first container 100. In another embodiment, the lids may be sized and shaped such that when the bases are in a nested arrangement then the lid of the third container is not nested in the lid of the second container and the lid of the second container is not nested in the lid of the first container. In such an embodiment, the lids may have shorter sidewalls than the sidewalls of the lids 160, 260, and 360. When the lids have shorter sidewalls than the bases as opposed to equal heights, it is easier to separate the containers. In one embodiment, more force is required to separate the containers by hand when the containers are in the stacked arrangement than is required to separate the containers when the containers are in the nested arrangement. In another embodiment, more force is required to separate the containers by hand when the containers are in the nested arrangement than is required to separate the containers when the containers are in the stacked arrangement.

FIG. 3B is an enlarged depiction of the locking tabs 140*b*, 240*b*, and 340*b*. FIG. 3C is a cross-sectional view of the lightly stacked locking tabs 140*b*, 240*b*, and 340*b* to show the alternating arrangement of the base indentations 149*b*, 249*b*, and 349*b*. In these embodiments, a plurality of open containers are in a nested arrangement having the base sidewall 111 of the first container 100 abutting the base sidewall 211 of the second container 200 and the base sidewall 211 of the second container 200 abutting the base sidewall 311 of the third container 300. Similarly, a lid sidewall 161 of the first container 100 may abut the lid sidewall 261 of a second container 200 and the lid sidewall 261 of the second container 200 may abut the lid sidewall 361 of the third container 300 in a nested arrangement. However, the height of the lid sidewalls may be less than the height of the base sidewalls such that the lid sidewalls do not abut each other when the base sidewalls of the plurality of open containers are in a nested arrangement.

Figure 3D:
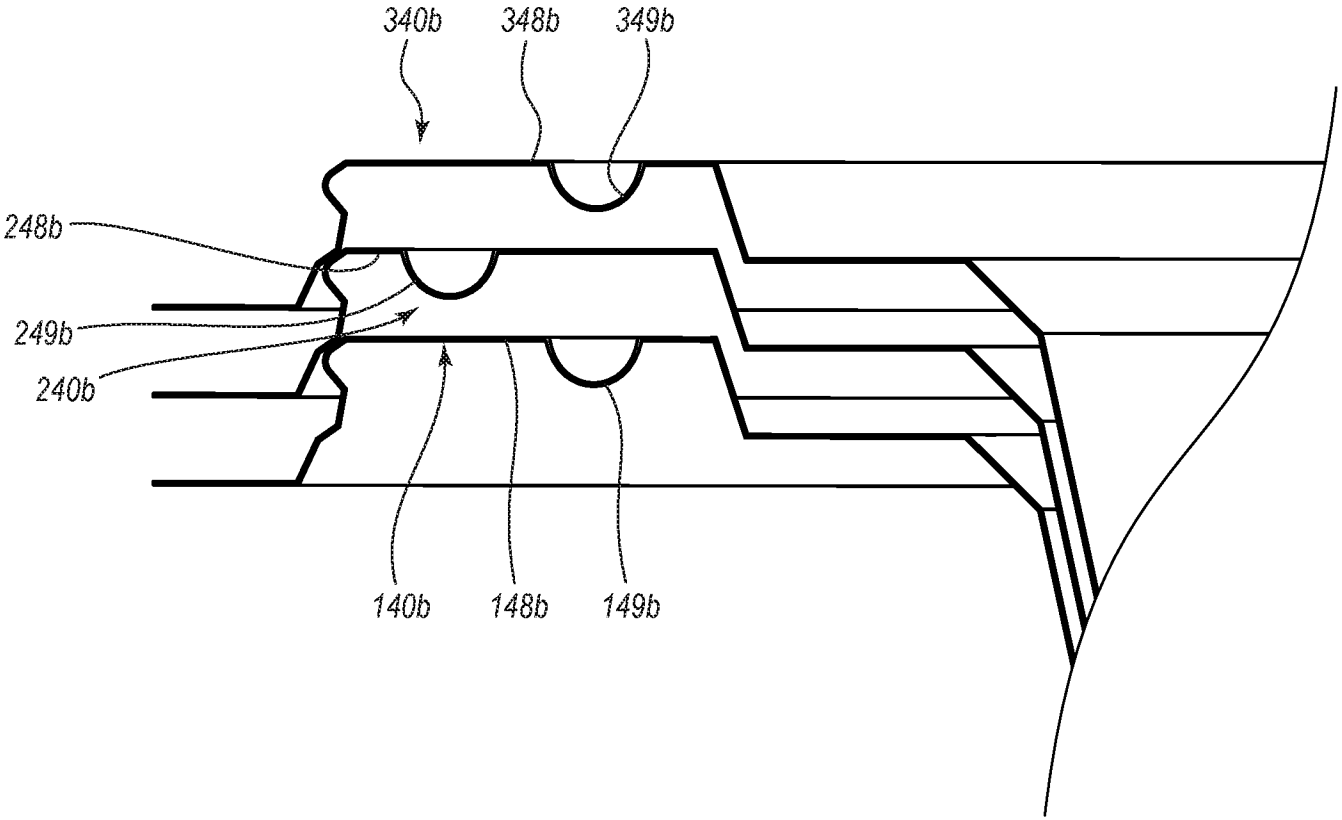
FIG. 3D is a cross-sectional view of the locking tabs of three bases of the three stacked containers of FIG. 3A after the bases have been compressed towards each other in the nested arrangement but not far enough for a bump in a flat top of a head of a locking tab to contact an adjacent flat top

FIG. 3D is an enlarged cross-sectional view of the locking tabs 140*b*, 240*b*, and 340*b* after the containers 100, 200, and 300 have been compressed together. The lid indentation 149*b* has a top surface that acts as a recess and a bottom surface that acts as a bump. When the containers are in the nested arrangement, the bottom surface of the base indentation 249*b* of the locking tab of the second container 200 is oriented toward the flat top 148*b* of the corresponding locking tab 140*b* of the first container.

Figure 3E:
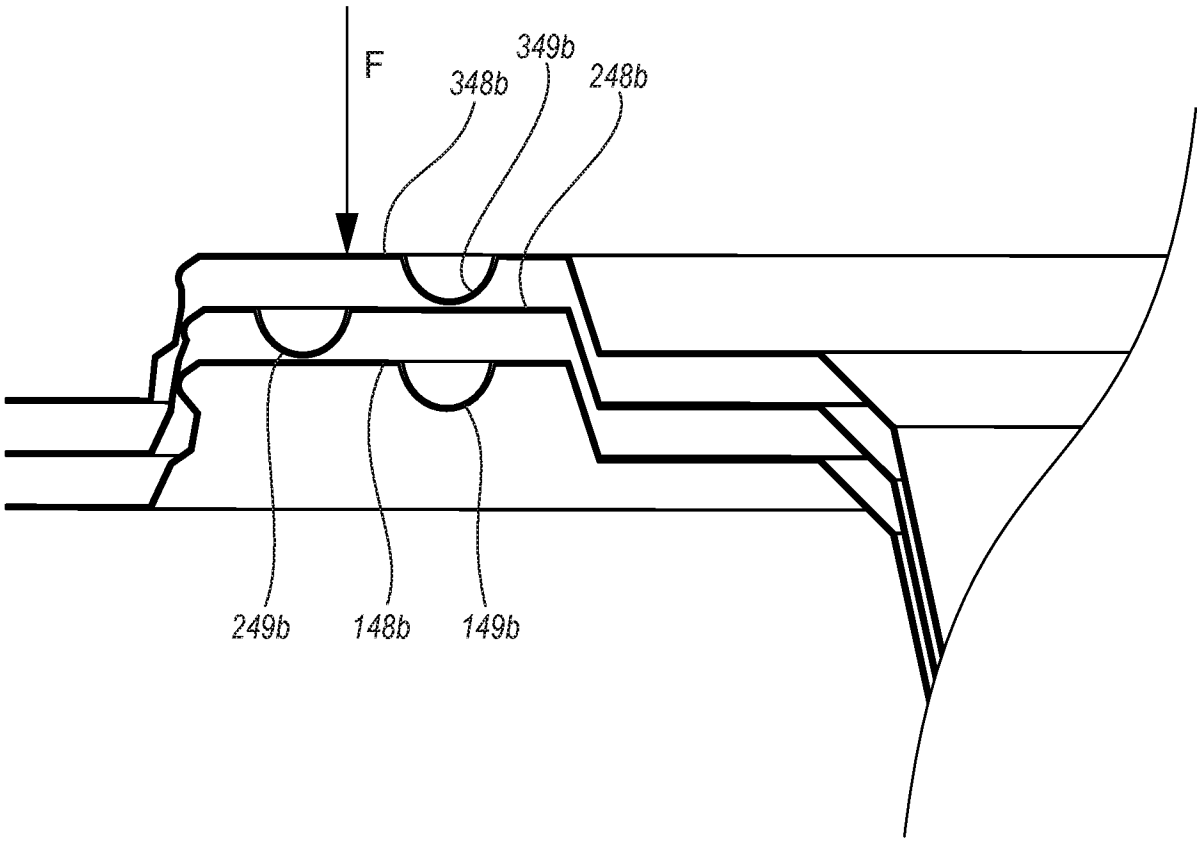
FIG. 3E is a cross-sectional view of the locking tabs of three bases of the three stacked containers of FIG. 3C after the bases have been further compressed towards each other relative to the cross-section view in FIG. 3D such that a bump in a flat top of a head of a locking tab contacts an adjacent flat top.

FIG. 3E is also an enlarged cross-sectional view of the locking tabs 140*b*, 240*b*, and 340*b* after the containers 100, 200, and 300 have been further compressed together such that they are tightly stacked. The locking tabs 140*b*, 240*b*, and 340*b* have alternating arrangement of base indentations 149*b*, 249*b*, and 349*b*. As shown in FIG. 3E, the indentation 249*a* has a surface that contacts the flat top 148*b* of the locking tab 140*b*. As also shown in FIG. 3E, the indentation 349*a* has a surface that contacts the flat top 248*b* of the locking tab 240*b*. FIG. 3E shows compression of the bottom surface of the base indentation 249*b* of the locking tab 240*b* of the second container 200 toward the flat top 148*b* of the corresponding locking tab 140*b* of the first container 100 to cause the face of the locking tab 240*b* of the second container 200 to engage the face of the locking tab 140*b* of the first container 100 without any segment of the face of the locking tab 240*b* of the second container 200 locking with a segment of the face of the locking tab 140*b* of the first container 100. Additionally, the face of the locking cover 240*b* of the second container 200 flexes radially outward upon compression of the bottom surface of the base indentation of the locking tab 240*b* of the second container 200 toward the flat top 148*b* of the corresponding locking tab 140*b* of the first container 100.

As used herein, the terms "nested" and "nesting" generally refer to more than one of the vented containers that are placed on top of each other in an open configuration, such as illustrated in FIGS. 3A-3E. This is in contrast to the terms "stacked" and "stacking," which generally refer to more than one of the containers that are placed vertically on top of each other in a closed position as illustrated in FIGS. 2A-2B. Thus, for example, a plurality of open containers may be configured such that the first container may abut a surface of the second container and the second container may abut a surface of the third container in a nested arrangement. In an embodiment, the mated stacking structures of a plurality of closed containers in a stacked arrangement as shown in FIGS. 2A-2D, have smaller tolerances than the abutting surfaces of the open containers in a nested arrangement, described with reference to FIGS. 3A-3E.

As mentioned, the height of the sidewalls 111 and 161 may vary, including to conform to the intended food products to be packaged therein. For example, a container having a long and narrow lid and base with short sidewalls may be suitable for packaging hot dogs and onion rings, as compared to a container having a square or circular lid and base with tall sidewalls that may be suitable for packaging a hamburger. In certain embodiments, the height of the lid sidewall 161 may be between about 1 and about 3 inches, between about 1.75 and about 2.75 inches, or between about 2 and about 2.5 inches. In some embodiments, the height of the base sidewall 111 may be between about 1 and about 4 inches, between about 1.5 and about 3 inches, or between about 2.5 and about 3 inches. Additionally, the height of the base sidewall 111 and the height of the lid sidewall 161 may be approximately equal.

The base sidewall 111 extends downwardly from the base brim 130 to the bottom end 106 in a configuration that is angled radially inward, as shown in FIG. 1C. Stated otherwise, the base sidewall 111 extends upwardly from the bottom end 106 and is angled radially outwardly from the bottom end to the base brim 130. The base sidewall 111 may extend upwardly in a radially outward direction at an angle such as an angle of about 5 to about 18 degrees, or from about 5 to about 10 degrees. In some embodiments, the base sidewall 111 may extend downwardly in a substantially vertical manner that it is substantially perpendicular to the bottom end 106. The base sidewall 111 may also extend in a curved or arcuate manner. Accordingly, as can be appreciated, the base sidewall 111 may extend in a variety of ways depending on the desired shape and characteristics of the container 100.

The lid sidewall 161 extends upwardly from lid brim 180 to the top end 108 and is also angled radially inward from lid brim 180 to the top end 108. Stated otherwise, the lid sidewall 161 extends downwardly from the top end 108 and is angled radially outwardly from the top end 108 to the lid brim 180. The lid sidewall 161 may extend downwardly in a radially outward direction at an angle such as an angle of about 5 to about 18 degrees, or from about 5 to about 10 degrees. In some embodiments, the lid sidewall 161 may extend upwardly in a substantially vertical manner that it is substantially perpendicular to the bottom end 108. The base sidewall 111 and the lid sidewall 161 may extend in a curved or arcuate manner. Accordingly, as can be appreciated, the base sidewall 111 and the lid sidewall 161 may extend in a variety of ways depending on the desired shape and characteristics of the container 100.

The base sidewall 111, the base platform segments 114*a-d*, and the base face 116 may independently be substantially uniform or flat, or they may comprise one or more features for reinforcement, grip assistance, efficient stacking, venting, etc. For example, in the embodiment illustrated in FIG. 1B, base sidewall 111 comprises reinforced rounded corners. The reinforced rounded corners may provide the base 110 with strength and/or may augment its rigidity. In some embodiments of the containers 100 disclosed herein, at least a portion of the bottom end 106 such as the base face 116 of the base 110 may be substantially planar. The base platform segments 114*a-d* have a contact surface and at least a portion of this contact surface is substantially planar such that the base 110 may readily rest upon a planar surface such as the lid platform of another container in a horizontal arrangement, as shown in FIGS. 2A-2D.

The lid sidewall 161, lid platform 164, and lid face 166 of lid 160 may independently be substantially uniform or flat, or they may comprise one or more features for reinforcement, grip assistance, efficient stacking, venting, etc. For example, in the embodiment illustrated in FIG. 1B, lid sidewall 161 comprises reinforced rounded corners. The reinforced rounded corners may provide the lid 160 with strength and/or may augment its rigidity. In some embodiments of the containers 100 disclosed herein, at least a portion of the top end 108 such as the lid face 166 of the lid 160 may be substantially planar. The lid platform 164 has a contact surface and at least a portion of this contact surface is substantially planar such that the lid platform 164 may abut and support the planar surfaces of the base platform segments of another container in a horizontal arrangement, as shown in FIGS. 2A-2D.

The flexing portion of hinge 150 may include a region of reduced thickness compared to the thickness of the material used for the lid or base, and may be formed by any suitable method. For example, the hinge may be formed by a molding technique referred to as "coining" which involves thinning by deformation of the sheet used to form the container such that the hinge is an area with a thinner cross-section than adjacent portions. In certain embodiments, the hinge is formed by a frangible line, a line of perforation, and/or a region of reduced thickness. The hinge may be formed with a single fold line or with multiple fold lines.

A hinge may extend along the entire length of the side of the container to which it is connected, or it may extend along a portion of the length. For example, the hinge may extend along a majority (that is, more than about half) of the length of the lid to which it is connected, as shown for hinge 150 in FIG. 1A. More particularly, the hinge 150 extends from the base brim 130, namely the flange 133. In some embodiments, the hinge may extend about at least a minority (that is, less than about half) of the side of the container to which it is connected. For example, the length of the hinge may be about at least about ½, ⅔, or ¾ of the total length of a side (or of a 90 degree angle or quadrant portion, for circular containers) of the container to which it is connected. The length of hinge may be a smaller portion of the length of the container to which it is connected.

In an embodiment, the length of hinge 150 connecting the lid 160 and the base of container 100 may be between about 0.5 and about 6 inches long. In certain embodiments, the length of hinge 150 may be between about 1 and about 5 inches long, such as between about 1.5 and about 4.5 inches long, or it may between about 2.0 and about 4.0 inches long.

In the closed position, the base 110 and the lid 160 may cooperate such that a cavity is defined by the interior volume of the container, or stated otherwise, is enclosed by the base 110 and the lid 160. More specifically, the bottom end 106 of the base 110, the base sidewall 111, the lid sidewall 111, and the top end 108 of the lid 160 are the main components cooperating to define an interior cavity.

The base 110 and the lid 160 may be configured to sealingly engage with each other at their interfaces 132 and 182 to deter inadvertent opening of the container when the vented container is closed, and/or to limit leakage or loss of the container contents. The abutment of the interfaces 132 and 182 stabilizes the lid-base interface. In addition to the U-shape of interface 182 (as viewed in FIG. 1A and in the cross-sectional view of FIGS. 1E-1G) and the inverted U-shape of interface 132 (as viewed in FIG. 1A and in the cross-sectional view of FIGS. 1E-1G), the cooperative connection that extends around all or some of the circumference of the container may have other configurations such as a W-shape or a V-shape. In the depicted embodiments, the interfaces 132 and 182 extend around the entire perimeter of the base 110 and the lid 160. However, the interfaces may also extend around just a portion such as about at least ½, ⅔, or ¾ of the total perimeter of the base and the lid.

The lid flange 183, which extends radially outward from the bottom of the locking cover 190*a*, may contact and rest upon the base flange 133 in the same horizontal plane or at least be adjacent to each other in the same horizontal plane. The free edge 184 of the lid flange 183 may extend radially beyond the free edge 134 of the base flange 133 as shown in FIG. 1E, which eases grasping and flexing of the locking cover 190*a*. In addition to enclosing the container contents, the interaction of the base flange 133 and the lid flange 183 stabilizes the lid-base interface and provides additional dimensional stability to the container.

The material used to form the vented containers disclosed herein may be any suitable material. In an embodiment, the container may be formed of a polymeric foam, a thermoformed plastic, or a combination of a polymeric foam and a thermoformed plastic. Examples of suitable materials include polyethylene terephthalate (PET) and polypropylene (PP). Other materials suitable for forming the containers disclosed herein include polystyrene (PS) including expanded PS and oriented PS, crystalline polyethylene terephthalate (CPET), amorphous polyethylene terephthalate (APET), high density polyethylene (HDPE), polyvinyl chloride (PVC), polycarbonate (PC), polyester, polyolefin, and foamed polypropylene. The materials used to form the vented containers may be generally transparent or clarified, to allow a user to view the contents, or they may be opaque. The materials used to form any one section or element of the container, such as the lid or the base, may independently be the same as, or may be different from, the material used to form any other section, such as a hinge.

The material used to form the vented containers disclosed herein may also include paper, aluminum and/or a fiber. Examples of fibers include a fiber derived from a plant or animal such as cotton, cellulose, bamboo, or silk, and fibers derived via a chemical process in the laboratory, such as polyamide, polyester, polyolefin and acrylic fibers. Paper and/or aluminum may be used to strengthen the container and/or to provide the container with improved heat resistance or durability.

As mentioned, the base 110, hinge 150, and lid 160 may be integrally formed from a unitary piece of material. For example, in some embodiments the container may be formed from a single piece of thermoformed plastic. However, more than one material may also be used such as an embodiment where a different material is used for the hinges.

References to approximations are made throughout this specification, such as by use of the terms "about" or "approximately." For each such reference, it is to be understood that, in some embodiments, the value, feature, or characteristic may be specified without approximation. For example, where qualifiers such as "about," "substantially,"

and "generally" are used, these terms include within their scope the qualified words in the absence of their qualifiers. For example, where the term "substantially planar" is recited with respect to a feature, it is understood that in further embodiments, the feature can have a precisely planar configuration.

Reference throughout this specification to "an embodiment" or "the embodiment" means that a particular feature, structure or characteristic described in connection with that embodiment is included in at least one embodiment. Thus, the quoted phrases, or variations thereof, as recited throughout this specification are not necessarily all referring to the same embodiment.

Similarly, it should be appreciated that in the above description of embodiments, various features are sometimes grouped together in a single embodiment, figure, or description thereof for the purpose of streamlining the disclosure. This method of disclosure, however, is not to be interpreted as reflecting an intention that any claim require more features than those expressly recited in that claim. Rather, as the following claims reflect, inventive aspects lie in a combination of fewer than all features of any single foregoing disclosed embodiment.

The claims following this written disclosure are hereby expressly incorporated into the present written disclosure, with each claim standing on its own as a separate embodiment. This disclosure includes all permutations of the independent claims with their dependent claims. Moreover, additional embodiments capable of derivation from the independent and dependent claims that follow are also expressly incorporated into the present written description. These additional embodiments are determined by replacing the dependency of a given dependent claim with the phrase "any of the preceding claims up to and including claim [x]," where the bracketed term "[x]" is replaced with the number of the most recently recited independent claim. For example, for the first claim set that begins with independent claim 1, claim 3 can depend from either of claims 1 and 2, with these separate dependencies yielding two distinct embodiments; claim 4 can depend from any one of claim 1, 2, or 3, with these separate dependencies yielding three distinct embodiments; claim 5 can depend from any one of claim 1, 2, 3, or 4, with these separate dependencies yielding four distinct embodiments; and so on.

Recitation in the claims of the term "first" with respect to a feature or element does not necessarily imply the existence of a second or additional such feature or element. Elements specifically recited in means-plus-function format, if any, are intended to be construed in accordance with 35 U.S.C. § 112 ¶ 16. Embodiments of the invention in which an exclusive property or privilege is claimed are defined as follows.

The invention claimed is:

1. A plurality of containers comprising:

a first container and a second container, wherein each container comprises a base connected to a lid via a hinge, wherein each container may be in an open position or a closed position, wherein each container has a top end at its lid and a bottom end at its base such that the top end is above the bottom end when each container is in the closed position;

wherein the base comprises a base sidewall and a base platform, wherein the base platform comprises a plurality of base platform segments, wherein the base sidewall extends to the plurality of base platform segments at the bottom end of each container, wherein each base platform segment extends partially around and defines a base stacking receptacle, wherein the base stacking receptacle has a base face, wherein each of the base platform segments has a top and each top of each base platform segment is vertically offset from the base face of the base stacking receptacle, wherein the base platform segments are radially outward relative to the base stacking receptacle, wherein each base platform segment has opposing ends;

wherein a plurality of vent portals are positioned in the base at the bottom end of each container, wherein each vent portal is defined by a ceiling and by two ends of two adjacent base platform segments, wherein the ceiling of each vent portal is vertically offset from the tops of the base platform segments, wherein the ceiling of each vent portal extends to the base face of the base stacking receptacle;

wherein the ceiling of each vent portal transitions to an adjacent base chamfered corner that is angled upward relative to the ceiling such that the ceiling of each vent portal and the adjacent base chamfered corner are not coplanar;

wherein the lid comprises a lid sidewall, wherein the lid sidewall extends to a lid platform at the top end of each container, wherein the lid platform extends at least partially around a lid stacking protrusion that is vertically offset from the lid platform, wherein the lid platform is radially outward relative to the lid stacking protrusion;

wherein a plurality of vents are positioned in the lid platform;

wherein, when the containers are in the closed position, the lid stacking protrusion of the first container may be mated with the base stacking receptacle of the second container to permit the second container to be stacked on the first container in a stacked arrangement with the base platform of the second container over the lid platform of the first container and with the vent portals of the second container over the vents of the first container such that each vent portal of the second container is paired with, over, and vertically offset from one of the vents of the first container; and wherein the vents and the vent portals are configured such that, when the containers are in the closed position and in the stacked arrangement, each vent of the first container may be in an open configuration without being covered by or otherwise obstructed by one of the vent portals of the second container, whereby heat and/or moisture may be vented from the first container despite being stacked under the second container.

2. The plurality of containers of claim 1, wherein each vent portal comprises a neck that transitions to a mouth, wherein the mouth has a wider width relative to the neck, wherein the mouth is radially outward relative to the neck, wherein the mouth of each vent portal is at least partially located in a shoulder of the base, and wherein the shoulder transitions to the base sidewall; and wherein, when the containers are in the closed position and in the stacked arrangement, each vent is visible via the mouth of the vent portal with which the vent is respectively paired.

3. The plurality of containers of claim 1, wherein each vent portal comprises a neck that transitions to a mouth, wherein the mouth has a wider width relative to the neck, wherein the mouth is radially outward relative to the neck, and wherein the ceiling of the vent portal at the mouth of the vent portal transitions to one of the base chamfered corners.

4. The plurality of containers of claim 1, wherein each vent is a C-shaped vent, wherein each C-shaped vent has a flap extending from a connecting portion that connects the flap with a surrounding region of the lid platform, and wherein the flap is defined by a weakened line in the lid platform when the vent is in a closed configuration.

5. The plurality of containers of claim 1, wherein, when the containers are in the closed position and in the stacked arrangement, each vent is visible via the vent portal with which the vent is respectively paired.

6. The plurality of containers of claim 1, wherein the vertical offset between the base face and the top of each base platform segment is the same as a vertical offset between the ceiling of each vent portal and the top of each of the base platform segments.

7. The plurality of containers of claim 1, wherein the stacking protrusion of the lid of the first container fits in a friction-fit configuration with a stacking recess of the base of the second container.

8. The plurality of containers of claim 7, wherein the friction-fit configuration requires a user to grasp the first container with one hand and the second container with a second hand to apply force to separate the containers by hand.

9. A plurality of containers comprising:

a first container and a second container, wherein each container comprises a base connected to a lid via a hinge, wherein each container may be in an open position or a closed position, wherein each container has a top end at its lid and a bottom end at its base such that the top end is above the bottom end when each container is in the closed position;

wherein the base comprises a base sidewall and a base platform, wherein the base platform comprises a plurality of base platform segments, wherein the base sidewall extends to the plurality of base platform segments at the bottom end of each container, wherein each base platform segment extends partially around and defines a base stacking receptacle, wherein the base stacking receptacle has a base face, wherein each of the base platform segments has a top and each top of each base platform segment is vertically offset from the base face of the base stacking receptacle, wherein the base platform segments are radially outward relative to the base stacking receptacle, wherein each base platform segment has opposing ends;

wherein a plurality of vent portals are positioned in the base at the bottom end of each container, wherein each vent portal is defined by a ceiling and by two ends of the two adjacent base platform segments, wherein the ceiling of each vent portal is vertically offset from the tops of the base platform segments, wherein the ceiling of each vent portal extends to the base face of the base stacking receptacle;

wherein the ceiling of each vent portal transitions to an adjacent base chamfered corner that is angled upward relative to the ceiling such that the ceiling of each vent portal and the adjacent base chamfered corner are not coplanar;

wherein the lid comprises a lid sidewall, wherein the lid sidewall extends to a lid platform at the top end of each container, wherein the lid platform extends at least partially around a lid stacking protrusion that is vertically offset from the lid platform, wherein the lid platform is radially outward relative to the lid stacking protrusion;

wherein a plurality of vents are positioned in the lid platform;

wherein each vent is near a lid chamfered corner in the lid;

wherein, when the containers are in the closed position, the lid stacking protrusion of the first container may be mated with the base stacking receptacle of the second container to permit the second container to be stacked on the first container in a stacked arrangement with the base platform of the second container over the lid platform of the first container and with the vent portals of the second container over the vents of the first container such that each vent portal of the second container is paired with, over, and vertically offset from one of the vents of the first container; and wherein the vents and the vent portals are configured such that, when the containers are in the closed position and in the stacked arrangement, each vent of the first container may be in an open configuration without being covered by one of the vent portals of the second container, whereby heat and/or moisture may be vented from the first container despite being stacked under the second container.

10. The plurality of containers of claim 9, wherein each vent is a C-shaped vent, wherein each C-shaped vent has a vent flap extending from a connecting portion that connects the vent flap with a surrounding region of the lid platform, and wherein the vent flap is defined by a weakened line in the lid platform when the vent is in a closed configuration.

11. The plurality of containers of claim 10, wherein, when the containers are in the closed position and in the stacked arrangement, there is a vertical space between each vent of the first container and each vent portal of the second container such that each vent flap may be pivoted upward without interference from the ceiling of the vent portal.

12. The plurality of containers of claim 11, wherein each vent portal comprises a neck that transitions to a mouth, wherein the mouth has a wider width relative to the neck, wherein the mouth is radially outward relative to the neck, wherein the mouth of each vent portal is at least partially located in a shoulder of the base, and wherein the shoulder transitions to the base sidewall.

13. The plurality of containers of claim 9, wherein the base is rectangular and comprises four corners, wherein the plurality of vent portals comprises four vent portals, and wherein each vent portal is at one of the corners of the base; and wherein the lid is rectangular and comprises four corners, wherein the plurality of vents comprises four vents, and wherein each vent is at one of the corners of the lid.

14. The plurality of containers of claim 9, wherein, when the containers are in the closed position and in the stacked arrangement, there is a vertical space between each vent of the first container and each corresponding vent portal of the second container;

wherein, when the containers are in the closed position and in the stacked arrangement, each base chamfered corner of the second container is over and paired with a corresponding lid chamfered corner of the first container such that there a vertical space between each paired lid chamfered corner of the first container and base chamfered corner of the second container; and wherein the vertical space between each paired lid chamfered corner of the first container and base chamfered corner of the second container is greater than the vertical space between each vent of the first container and each corresponding vent portal of the second container.

15. A plurality of containers comprising:

a first container and a second container, wherein each container comprises a base connected to a lid via a hinge, wherein each container may be in an open position or a closed position, wherein each container has a top end at its lid and a bottom end at its base such that the top end is above the bottom end when each container is in the closed position;

wherein the base comprises a base sidewall and a base platform, wherein the base platform comprises a plurality of base platform segments, wherein the base sidewall extends to the plurality of base platform segments at the bottom end of each container, wherein each base platform segment extends partially around and defines a base stacking receptacle, wherein the base stacking receptacle has a base face, wherein each of the base platform segments has a top and each top of each base platform segment is vertically offset from the base face of the base stacking receptacle, wherein the base platform segments are radially outward relative to the base stacking receptacle, wherein each base platform segment has opposing ends;

wherein a plurality of vent portals are positioned in the base at the bottom end of each container, wherein each vent portal is defined by a ceiling and by two ends of two adjacent base platform segments, wherein the ceiling of each vent portal is vertically offset from the tops of the base platform segments, wherein each vent portal comprises a neck that transitions to a mouth, wherein the mouth has a wider width relative to the neck, wherein the mouth is radially outward relative to the neck, wherein the ceiling of each vent portal extends to the base face of the base stacking receptacle;

wherein the ceiling of each vent portal transitions at the mouth of the vent portal to an adjacent base chamfered corner that is angled upward relative to the ceiling such that the ceiling of each vent portal and the adjacent base chamfered corner are not coplanar;

wherein the lid comprises a lid sidewall, wherein the lid sidewall extends to a lid platform at the top end of each container, wherein the lid platform extends at least partially around a lid stacking protrusion, wherein the lid stacking protrusion is vertically offset from the lid platform, wherein the lid platform is radially outward relative to the lid stacking protrusion;

wherein a plurality of vents are positioned in the lid platform;

wherein each vent is near a lid chamfered corner in the lid;

wherein, when the containers are in a closed position, the lid stacking protrusion of the first container may be mated with the base stacking receptacle of the second container to permit the second container to be stacked on the first container in a stacked arrangement with the base platform of the second container over the lid platform of the first container and with the vent portals of the second container over the vents of the first container such that each vent portal of the second container is paired with, over, and vertically offset from one of the vents of the first container; and wherein the vents and the vent portals are configured such that, when the containers are in the closed position and in the stacked arrangement, each vent of the first container may be in an open configuration without being covered by or otherwise obstructed by one of the vent portals of the second container, whereby heat and/or moisture may be vented from the first container despite being stacked under the second container.

16. The plurality of containers of claim 15, wherein the lid stacking protrusion has a rectangular shape with rounded corners.

17. The plurality of containers of claim 15, wherein each vent is a C-shaped vent with a flap extending from a connecting portion that connects the flap with the surrounding region of the lid platform, wherein the flap is defined by a weakened line in the lid platform when the vent is in a closed configuration.

18. The plurality of containers of claim 15, wherein the base platform segments are equally vertically offset from the base face and each ceiling of each vent portal.

19. The plurality of containers of claim 15, wherein each corner is a rounded corner.

20. The plurality of containers of claim 15, wherein, when the containers are in the closed position and in the stacked arrangement, there is a vertical space between each vent of the first container and each corresponding vent portal of the second container;

wherein, when the containers are in the closed position and in the stacked arrangement, each base chamfered corner of the second container is over and paired with a corresponding lid chamfered corner of the first container such that there a vertical space between each paired lid chamfered corner of the first container and base chamfered corner of the second container; and wherein the vertical space between each paired lid chamfered corner of the first container and base chamfered corner of the second container is greater than the vertical space between each vent of the first container and each corresponding vent portal of the second container.

21. The plurality of containers of claim 1, wherein the ceiling of each vent portal is coplanar with regions of the base face of the base stacking receptacle.

22. The plurality of containers of claim 9, wherein the ceiling of each vent portal is coplanar with regions of the base face of the base stacking receptacle.

23. The plurality of containers of claim 15, wherein the ceiling of each vent portal is coplanar with regions of the base face of the base stacking receptacle.

24. The plurality of containers of claim 1, wherein, when the containers are in the closed position and in the stacked arrangement, the base platform of the second container rests on the lid platform of the first container.

25. The plurality of containers of claim 9, wherein, when the containers are in the closed position and in the stacked arrangement, the base platform of the second container rests on the lid platform of the first container.

26. The plurality of containers of claim 15, wherein, when the containers are in the closed position and in the stacked arrangement, the base platform of the second container rests on the lid platform of the first container.

27. The plurality of containers of claim 14, wherein the vertical space between each paired lid chamfered corner of the first container and base chamfered corner of the second container increases radially outward.

28. The plurality of containers of claim 20, wherein, the vertical space between each paired lid chamfered corner of the first container and base chamfered corner of the second container increases radially outward.

* * * * *